US005083640A

United States Patent [19]

Tsuji

[11] Patent Number: 5,083,640

[45] Date of Patent: Jan. 28, 1992

[54] METHOD AND APPARATUS FOR EFFECTING GROUP MANAGEMENT OF ELEVATORS

[75] Inventor: Shintaro Tsuji, Inazawa, Japan

[73] Assignee: Mitsubishi Denki Kabushiki Kaisha, Inazawa, Japan

[21] Appl. No.: 538,359

[22] Filed: Jun. 13, 1990

[30] Foreign Application Priority Data

Jun. 26, 1989 [JP] Japan ..... 1-160714
Jun. 28, 1989 [JP] Japan ..... 1-166053

[51] Int. Cl.[5] ..... B66B 1/18
[52] U.S. Cl. ..... 187/127; 187/128
[58] Field of Search ..... 187/127, 125, 1 R

[56] References Cited

U.S. PATENT DOCUMENTS 3,561,571 2/1971 Gingrich ..... 187/127
4,669,579 6/1987 Ookubo ..... 187/124
4,724,931 2/1988 Ichioka ..... 187/101

*Primary Examiner*—A. D. Pellinen
*Assistant Examiner*—Lawrence E. Colbert
*Attorney, Agent, or Firm*—Leydig Voit & Mayer

[57] ABSTRACT

A group management method and apparatus for elevators is disclosed. The apparatus includes a car-position predicting device for predicting a car position and a car direction which will have been taken by each car when a predetermined time has elapsed, a predicted-empty-car detecting device for predicting from the predicted car position and direction an empty car which will be available when the predetermined time has elapsed, and an assignment restricting device for restricting the assignment of the predicted empty car to a floor call. In the group management method, a waiting time derived from a registered floor call which is assigned to each car is evaluated, and a car to be assigned to the floor call is selected on the basis of the result of the evaluation.

24 Claims, 14 Drawing Sheets

METHOD AND APPARATUS FOR EFFECTING GROUP MANAGEMENT OF ELEVATORS

BACKGROUND OF THE INVENTION

1. Field of the Invention

The invention relates to an apparatus for effecting group management of elevators which is responsive to a floor call for selecting an appropriate elevator from among a plurality of elevators and assigning it to the floor call, and to a method of effecting such group management.

2. Description of the Related Art

In general, a group management service is conducted in a building structure provided with a plurality of elevators. An assignment system is a typical example for effecting the group management service. The assignment system is arranged to calculate an assignment value for each car promptly after a floor call has been registered, select a car having an optimum assignment value, and assign the car to the floor call for the purpose of service. In the assignment system, since only a specified car is allowed to respond to the floor call, it is possible to realize an improved service efficiency and a reduced waiting time. In such an assignment type of group management elevator, it is common practice to dispose arrival warning lamps associated with each car and each direction of car travel at each terminal floor. Persons waiting at each terminal floor are informed which car has been assigned to the floor call by means of a warning indication provided by the arrival warning lamps. Accordingly, the waiting persons can easily move to the front of the door of a hatchway in which the specified car is located.

In the above-described floor-call assignment system, assignment values are calculated to determine which car should be assigned to a floor call of interest on the assumption that the current situation will change proportionally. More specifically, the predicted value of the time required for each car to arrive at each terminal floor in response to the floor call in sequence (hereinafter referred to as a "predicted arrival time") and the time elapsed after the floor call has been registered (hereinafter referred to as an "elapsed time") are obtained on the basis of the current position and direction of each car as well as the currently registered floor calls or car calls. In addition, predicted waiting times for all the currently registered floor calls are calculated by adding the predicted arrival time and the elapsed time. The sum of the predicted waiting times or the sum of the squares of the predicted waiting times is obtained and set as the aforesaid assignment value, and a car having a minimum assignment value is in turn assigned to the aforesaid floor call. However, such a conventional system has a number of problems. For instance, a decision as to whether the assignment of the floor call is optimum must be made on the basis of the current situation. As a result, if a user newly registers a floor call after the aforesaid assignment has been completed, the conventional system compels the user to wait for an excessively long time.

The aforementioned problem will be explained in further detail with reference to the example shown in FIGS. 15–18. Referring to FIG. 15, a first car A is travelling upward in response to a car call 6*c* of the sixth floor, while a second car B is assigned to an upward call 5*u* of the fifth floor and is travelling in response to an upward assignment 5*u*B. In this state, a downward call

9*d* is registered at the ninth floor as shown in FIG. 16. If an assignment value is obtained in accordance with the above-described conventional assignment system, the ninth-floor downward call 9*d* is assigned to the car A so as to minimize waiting time on average. The car A is given a downward assignment 9*d*A of the ninth floor, with the result that the two cars travel upwardly.

If an upward call 1*u* is registered at a lower floor, for example, at the first floor, a time delay after the downward call 9*d* of the ninth floor has been registered, the upward call 1*u* of the first floor is the second call with respect to the cars A and B. Even if the upward call 1*u* is assigned to either car, it will take a long time for the assigned car to respond thereto and users are compelled to wait for a long time.

If the downward call 9*d* of the ninth floor is assigned to the car B, it is expected that, as shown in FIG. 17, about 15 seconds thereafter, the car A stops as an empty car at the sixth floor, while the car B is in service at the fifth floor, where a car call 10*c* of the tenth floor is assumed to be registered. In this case, even if the upward call 1*u* of the first floor is registered thereafter, the car A waiting at the sixth floor promptly moves to the first floor as shown in FIG. 18. Accordingly, users are not compelled to wait for a long time. As described above, to prevent the occurrence of a long waiting time, how the cars will be located in the near future and the possibility of a particular car becoming empty are considered and it is necessary to assign each floor call so as not to gather many cars at a specific location, although the assignment may temporarily lead to a long waiting time.

As will be explained below, a variety of proposals have been made with respect to a method capable of assigning floor calls so as to prevent many cars from gathering at a single location. However, with all of the proposed methods, the problem of excessive waiting times is present.

Japanese Patent Publication No. 55-32625 discloses a group management apparatus for elevators in order to prevent all cars from gather at a single location and improve service efficiency. The disclosed apparatus utilizes an assignment system in which, when a floor call is registered, this floor call is assigned to a car which is expected to stop at a terminal floor near the location where the floor call has occurred. However, such a conventional assignment system still involves the problem of long waiting time. This is because the conventional system merely pays attention to the presence or absence of a car which can stop at a nearby floor and makes no appropriate decision as to how long it takes until the car arrives at the floor of interest, how other registered floors are distributed, when a response to each of the other registered floors is provided, whether there is a car which will become empty in the near future, at what floor each car other than the car of interest is located, in what direction each car is about to travel, and so on.

Japanese Patent Publication No. 62-56076 discloses a group management method for elevators. The disclosed method is characterized by an assignment method in which a car is placed in a stand-by state at a floor where the last passenger has got off. The assignment method comprises the steps of: temporarily assigning a new floor call to each car in sequence to predict the locations where the respective temporarily assigned cars are rested; calculating the degrees of dispersion of the cars from the predicted stand-by locations of the respective temporarily assigned cars and the locations of the other cars; and setting at least the aforesaid degrees of dispersion as evaluated values for the respective temporarily assigned cars in such a manner that a car having a larger degree of dispersion is more easy to assign to the floor call, thereby selecting a specific car to which the floor call should be assigned on the basis of the evaluated values of the respective cars. In the assignment method having the above-described arrangement, even after the service of the floor call has been completed, the cars can be widely dispersed to prevent unnecessary empty cars from being moved in their dispersed stand-by states. Accordingly, the above-described assignment method has the advantages that considerable energy savings can be improved and that residents in a building can use elevators without nuisance. However, as is evident from the object disclosed in Japanese Patent Publication No. 62-56076, the above assignment method is intended for infrequent services, as in the nighttime and is based on the assumption that a single floor call is registered when all the cars are empty and at rest. For this reason, this assignment method cannot be applied to the assignment of floor calls under the service condition of floor calls being registered one after another with cars travelling in response to many calls, thus resulting in the problem of a long waiting time. A first reason why this problem results is that the above-described assignment method is intended to balance the positions of empty cars and therefore, is not arranged to allow for variations with time in the positions of the respective cars other than the aforesaid temporarily assigned cars. As can be seen from the assumption of such an assignment method, it is not necessary to allow for variations in the positions of the other cars. A second reason is that a decision as to the assignment of floor calls is made by paying attention to only the position which is taken by the aforesaid temporarily assigned car when the last passenger gets off and this car comes to a rest. (At this time, all the cars are empty and at rest.)

Another new group management system utilizing a fuzzy theory is proposed in "GROUP MANAGEMENT APPARATUS FOR ELEVATORS", a collection of papers, Vol 2, P 2, 117–120 published in a 1988 meeting associated with electricity and information technologies, held at the department of engineering of Niigata University on October 3–5, 1988. This paper described the following example. When a floor call occurs at, for example, an upper floor, if it is likely that, when this floor call is assigned to a certain car A, cars will gather at the upper floor, car candidates for assignment are specified except for a car or cars having this likelihood, and a car having a minimum assignment value is selected from among these car candidates for assignment.

This paper describes a certain simulation example such as that shown in FIG. 19. In the illustrated state, if a downward call at the tenth floor is registered, it is preferable that the car having the better assignment value be selected as an assigned car from a first car and a third car, each having a car call of an upper floor, not a second car and a fourth car which are empty. According to the teaching, it is possible to realize an assignment scheme in which a floor call which will occur in the near future is taken into account, whereby the occurrence of a long waiting time can be prevented. However, in this simulation example, the decision as to whether the cars gather at the upper floor is made on only the condition of "having a floor call at an upper floor" or "having an assigned call at an upper floor", and a variation in the positional relationship between the cars with time is not taken into account. Any car may arrive at the upper floor, but, since positional relationship with the other cars is not clearly determined, it is highly probable that cars will not "gather at the upper floor". In this case, waiting time will become even longer just because the empty cars are eliminated from the assignment.

The above-described problem will be explained in further detail with reference to the example shown in FIGS. 20–22. Referring to FIG. 20, the first car A is travelling upward through the fourth floor in response to the car call 6*c* of the sixth floor, while the second car B does not have a call of the sixth floor and is empty with its door closed. In this state, the downward call 9*d* is assumed to be registered at the ninth floor as shown in FIG. 21. According to the fuzzy rules described above, if the downward call 9*d* of the ninth floor is assigned to the car B, it is determined that the cars A and B gather at an upper floor. Accordingly, a car other than the empty car B—the car A in this example—is set as a car candidate for assignment, and the downward call 9*d* of the ninth floor is assigned to the car A. Accordingly, if the upward call 1*u* is registered at a lower floor, for example, the first floor, immediately after the downward call 9*d* of the ninth floor has been assigned, the upward call 1*u* of the first floor is assigned to the car B which is rested at the sixth floor and the car B promptly travels to the first floor. Therefore, an excessively long waiting time does not occur.

However, as described above, it is effective to exclude empty cars in only a service condition in which a floor call tends to relatively frequently occur at a lower floor. In the case of a considerably intermittent service condition in which no floor call appears at the lower floor for a while, the following arrangement is advantageous in minimize waiting time on average. The empty car B is caused to respond to the downward call 9*d* of the ninth floor. Then, regarding a floor call which will occur after a while, the car A which is expected to be empty at that time is caused to respond to the floor call; for example, if the downward call 9*d* of the ninth floor is not assigned to the car A, the car A, as shown in FIG. 22, completes its service at the sixth floor and becomes empty 15 seconds later.

As described above, in the conventional method, empty cars are eliminated from assignment processes without allowing for the probability that a car (or predicted empty car), which completes responding to a floor call and comes to a rest with its door closed, will appear in the near future. Accordingly, the problem of an insufficient reduction in waiting time still arises.

SUMMARY OF THE INVENTION

It is therefore an object of the present invention to solve the above-described problems.

It is another object of the present invention to provide a method and apparatus for effecting group management of elevators both of which make it possible to reduce waiting time which may occur from a floor call during the period lasting from the current point in time to the near future.

To achieve the above objects, according to one aspect of the present invention, there is provided a group management apparatus for elevators which comprises floor-call registering means for registering a floor call which occurs when a floor button is actuated; assigning means for selecting a car to serve the floor call from among a plurality of cars and then for assigning the selected car to the floor call; car controlling means for controlling operations of the car including the direction of travel of the car, the start and stop of the car and the opening and closing of the door of the car, and for causing the car to respond to a corresponding car call and floor call, stand-by means for placing the car in a stand-by state after the car has responded to all car calls; car-position predicting means sequentially responsive to the car call and the floor call for predicting a car position and a car direction of each of the cars to be realized when a predetermined time has elapsed; predicted-empty-car detecting means for detecting a car which is expected to have no call to respond to when the predetermined time has elapsed as a predicted empty car on the basis of the car position and the car direction predicted by the car-position predicting means, and assignment restricting means for selecting predicted empty car detected by the predicted-empty-car detecting means to be assigned to a floor call by the assigning means when the floor-call registering means registers the floor call.

According to another aspect of the present invention, there is provided a group management apparatus for elevators which comprises floor-call registering means for registering a floor call which occurs when a floor button is actuated, assigning means for selecting a car to serve the floor call from among a plurality of cars and then for assigning the selected car to the floor call; car controlling means for controlling the operation of the car including the direction of travel of the car, the start and stop of the car and the opening and closing of the door of the car and for causing the car to respond to a corresponding car call and floor call; stand-by means for placing the car in a stand-by state after the car has responded to all car calls; empty-car detecting means for detecting as an empty car a car having no call being responded to with its door closed; car-position predicting means sequentially responsive to the car call and the floor call for predicting a car position and a car direction of each of the cars to be realized when a predetermined time has elapsed; predicted-empty-car detecting means for detecting a car which is expected to be empty when the predetermined time has elapsed, the detection being made on the basis of the car position and the car direction predicted by the car-position predicting means; and assignment restricting means for restricting the manner in which at least one empty car detected by the empty-car detecting means is assigned to a floor call by the assigning means when the floor-call registering means registers the floor call in a case where the empty-car detecting means detects the aforesaid at least one empty car and the predicted-empty-car detecting means does not detect any predicted empty car.

According to yet another aspect of the present invention there is provided a group management method for elevators which comprises the steps of inputting a floor-button signal and a state signal transmitted from a car controller; registering a floor call on the basis of the floor-button signal and the state signal; detecting an empty car with its door closed having no call to be responded to; calculating the predicted arrival time which is required for a car to arrive at a terminal floor; calculating a future car position and a car direction which each car will attain when a predetermined time has elapsed; calculating the number of empty cars, defined by the number of predicted cars which are expected to be located in each zone when the predetermined time has elapsed, and the number of predicted empty cars which are expected to have no call to responded to; temporarily assigning a floor call to each car on the basis of the number of empty cars, the number of predicted cars and the number of predicted empty cars when the floor call is registered; evaluating a waiting time derived from the registered floor call which is assigned to each car; and selecting a car to be assigned to the floor call on the basis of the result of the step of evaluating, thereby effecting assignment.

The above and other objects, features and advantages of the present invention will be apparent from the following description of preferred embodiments of the invention with reference to the accompanying drawings.

The above and other objects, features and advantages of the present invention will be apparent from the following description of preferred embodiments of the invention with reference to the accompanying drawings.

DESCRIPTION OF THE PREFERRED EMBODIMENTS

Preferred embodiments of the present invention will be explained with reference to the accompanying drawings. FIGS. 1 to 10 are views which serve to illustrate a first embodiment of the present invention. In the following explanation of the first embodiment, it is assumed that four cars are installed in a twelve-story building.

Figure 1:
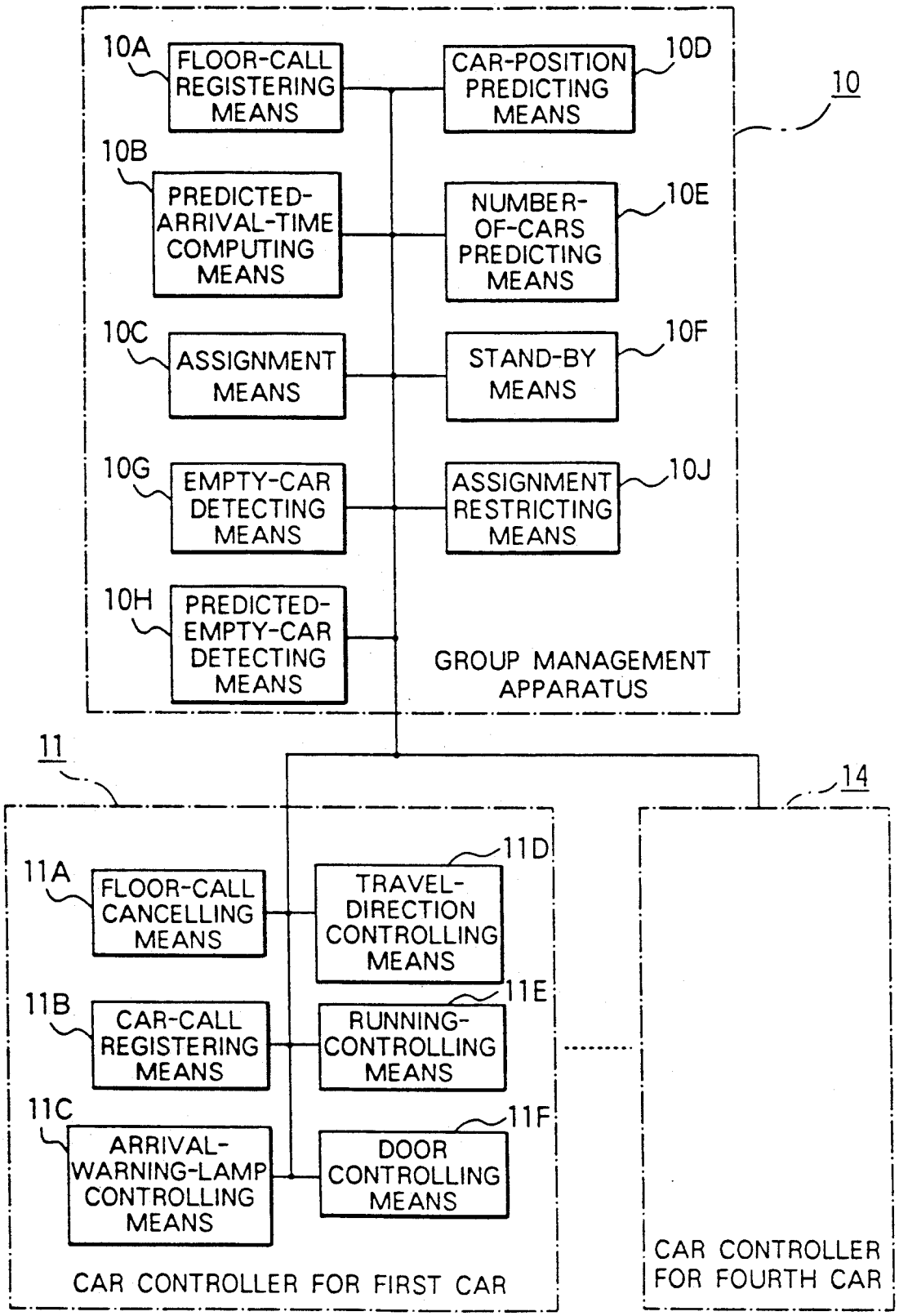
FIG. 1 is a block diagram showing the whole arrangement of a group management apparatus for elevators according to a first embodiment of the present invention.

FIG. 1 is a block diagram showing the whole arrangement of a group management apparatus for elevators according to the first embodiment, and the illustrated arrangement includes a group management apparatus 10 and car controllers 11 to 14 provided for controlling first to fourth cars, respectively. A floor-call registering means 10A performs registration/cancellation of a floor call (an upward call and a downward call) at each terminal floor and computes an elapsed time, that is, the time elapsed after the floor call has been registered. A predicted-arrival-time computing means 10B computes a predicted arrival time, that is, the predicted value of the time required for each car to arrive at each terminal floor irrespective of the direction of car travel. An assignment means 10C selects a single car which is best suited to serve a floor call and assigns the selected car thereto. The assignment means 10C performs assignment operations on the basis of a predicted waiting time derived from the floor call and an assignment restricting means which will be described later. A car-position predicting means 10D performs operations for predicting the position and direction of a car when a predetermined time T has elapsed after the current point in time. A number-of-cars predicting means 10E performs operations for predicting the number of cars which will be located in a predetermined terminal floor zone when the predetermined time T has elapsed, on the basis of the car position and the car direction which are predicted by the car-position predicting means 10D. A stand by means 10F places a car in a stand-by state at a specific floor or a terminal floor where the car is located when it has responded to all the calls. An empty-car detecting means 10G detects as an empty car a car which has its doors closed and is not responding to a call. A predicted empty car detecting means 10H detects a predicted empty car by selecting a car which is expected to be empty when the predetermined time T has elapsed from among a group of cars which have calls being responded to at the current point in time or which are responding to calls. An assignment restricting means 10J determines whether the assignment of a floor call to the aforesaid predicted empty car should be restricted or whether the predicted empty car should be eliminated from the group of cars to be specified for assignment.

A known floor-call cancelling means 11A is disposed in the car controller 11 for the first car, and generates a floor-call cancelling signal corresponding to a floor call transmitted from each terminal floor. The car controller 11 also includes a known car-call registering means 11B for registering the floor call transmitted from each terminal floor. A known arrival-warning-lamp controlling means 11C for controlling the operation of lighting the arrival warning lamp (not shown) is provided at each terminal floor. Car controller 11 further includes a known travel direction controlling means 11D for controlling and determining the direction of car travel. A known running controlling means 11E is provided for controlling the start, running and stop of a car to cause it to respond to a corresponding car call or an assigned floor call and a known door controlling means 11F is provided for controlling the opening and closing of a car door. Although not shown, the car controllers 12 to 14 for the second to fourth cars have substantially the same arrangement and construction as the car controller 11.

Figure 2:
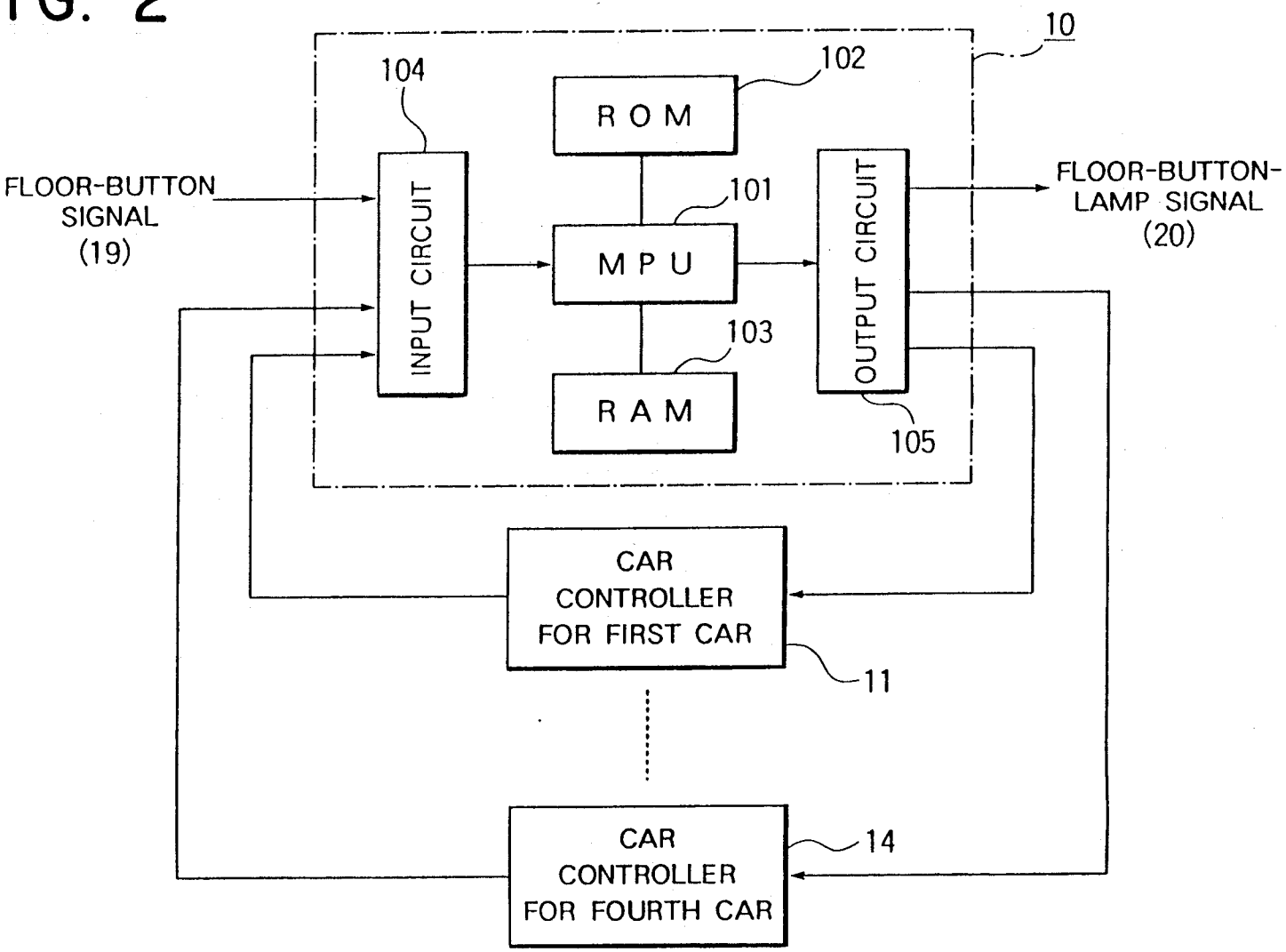
FIG. 2 is a block diagram showing the group management apparatus of FIG. 1.

As shown in FIG. 2, the group management apparatus 10 is made from a microcomputer including an MPU (micro processing unit) 101, a ROM 102, a RAM 103, an input circuit 104 and an output circuit 105. The input circuit 104 receives a floor-button signal 19 transmitted from a floor button provided at each terminal floor and state signals corresponding to the car controllers 11 to 14 for the first to fourth cars, respectively. The output circuit 105 outputs a signal 20 to a floor-button light included in each floor button, and command signals to the car controllers 11 to 14 for the first to fourth cars, respectively.

The operation of the first embodiment will now be explained with reference to FIGS. 3 to 8.

First, the gist of the group management operation will be explained with reference to FIG. 3.

The input program shown as Step 31 is made from a known program, and is used to input the floor-button signal 19 and state signals transmitted from the respective car controllers 11 to 14, which indicate information on car positions, car directions, the start, running and stop of each car, the opening and closing of each door, car loads or car calls, or floor call cancelling signals.

The floor-call registering program shown as Step 32 is a known program, and is used to determine whether a floor call should be registered or cancelled and/or whether a floor-button lamp should be turned on or off. The floor-call registering program also performs operations on the elapsed time of a floor call.

Figure 4:
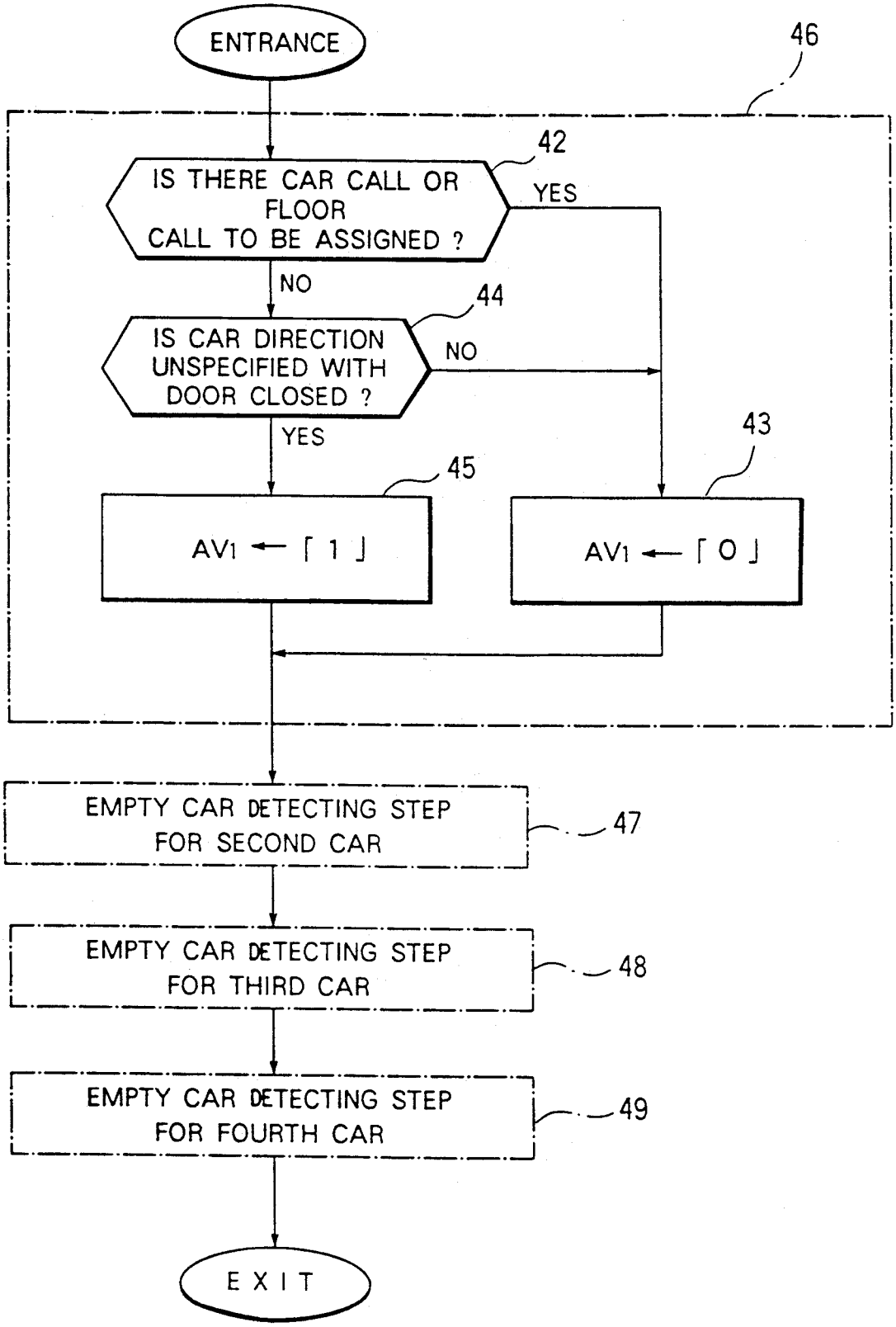
FIG. 4 is a flowchart of the empty-car detecting program of FIG. 3.

The empty-car detecting program shown as Step 33 detects as an empty car a car which has its doors closed and does not wait for a call being responded to, as shown in FIG. 4. In FIG. 4, Step 46, i.e., Steps 42–45, represent a procedure for detecting whether the first car is currently empty. If the first car does not have any car call or any assigned floor call and has no specified car direction with its door remaining closed, the process proceeds in the order Step 42→Step 44→Step 45. In Step 45, an empty-car flag $AV_1$ is set to "1". Otherwise, in Step 43, the empty-car flag $AV_1$ is reset to "0". Subsequently, in Steps 47, 48 and 49, it is likewise determined whether the respective second, third and fourth cars are empty, and corresponding empty-car flags are set to required levels.

The predicted-arrival time computing program shown as Step 34 performs operations on the predicted arrival time Aj(i) which is required for each car j (j=1, 2, 3, 4) to arrive at each terminal floor i. In this case, i=1, 2, . . . 11 represents the upward terminal floor provided at each floor B2, B1, 1, . . . , and 9, while i=12, 13, . . . , 22 corresponds to the downward terminal floor provided at each floor 10, 9, . . . , 1, and B1. The predicted arrival time is computed on the assumption that 2 seconds are required for a car to travel by one floor and 10 seconds are required for the car to come to a stop and that the cars travel throughout the terminal floors in predetermined sequence. The predicted arrival time is computed in a known manner.

The car-position predicting program shown as Step 35 performs predictive operations for obtaining predicted car positions $F_1(T)$–$F_4(T)$ and predicted car directions $D_1(T)$–$D_4(T)$ which will be taken by the respective first to fourth cars when the predetermined time T has elapsed. The car-position predicting program will be explained in detail with reference to FIG. 5.

Figure 5:
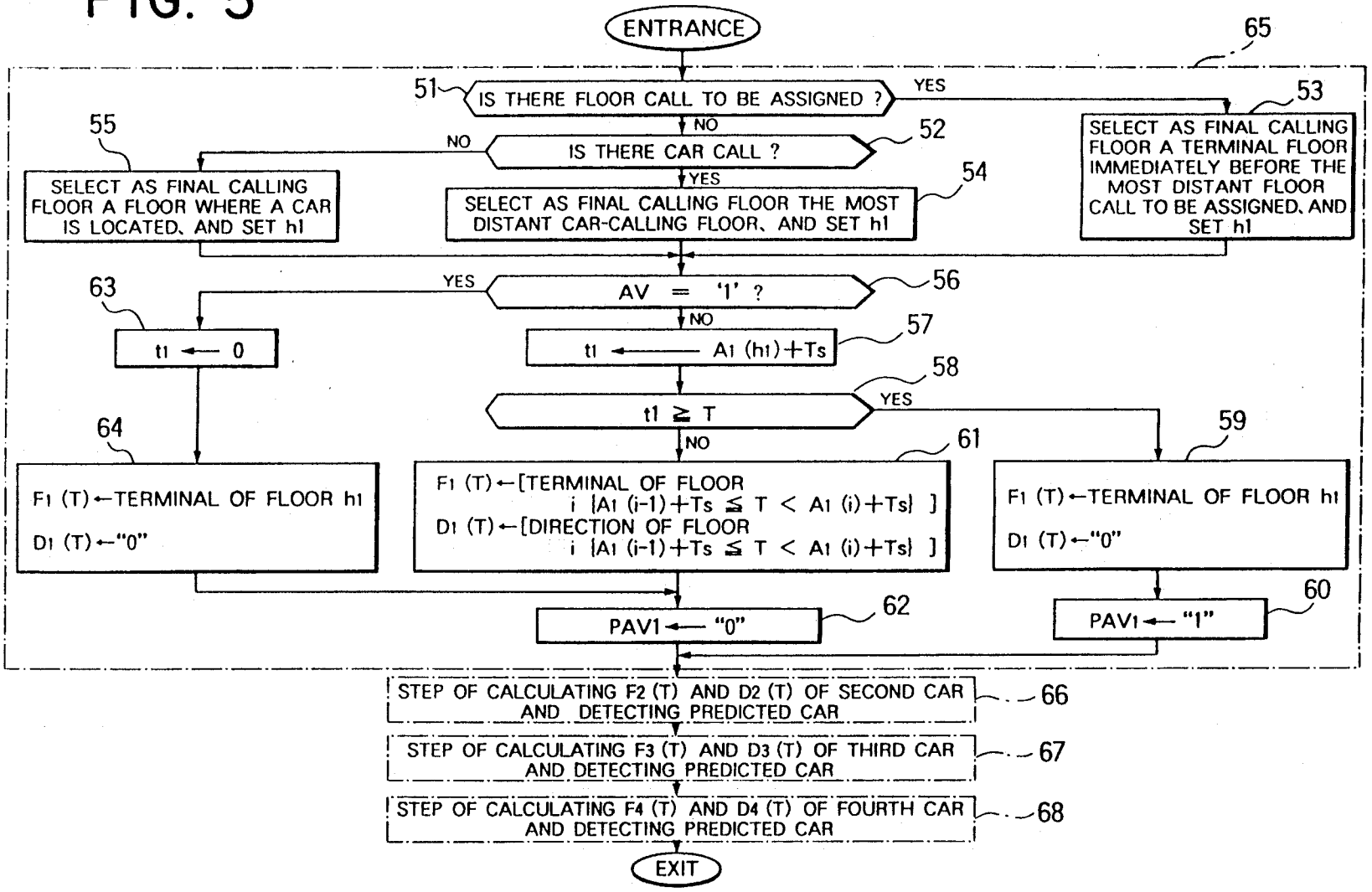
FIG. 5 is a flowchart of the car-position detecting program of FIG. 3.

In the car-position predicting program shown in FIG. 5, Step 65, that is, in Steps 51–64, represents the predicted car position $F_1(T)$ and predicted car direction $D_1(T)$ which is taken by the first car when the predetermined time T has elapsed. If any particular floor call is assigned to the first car, the process proceeds in the order Step 51→Step 53. In Step 53, it is predicted that a floor immediately before the most distant floor indicated by a particular floor call will be the final calling floor. This final calling floor is set as a final predicted calling floor $h_1$ by taking into account the direction in which the car arrives at that floor (the downward direction at the uppermost floor and the upward direction at the lowermost floor). If the first car waits for only a car call without waiting for an assigned floor call, the process proceeds in the order Step 51→Step 52→Step 54. In Step 54, it is predicted that the most distant floor which calls the first car is the final calling floor. This final calling floor is set as the final predicted calling floor $h_1$ by taking into account the direction in which the car arrives at that floor. In addition, if the first car has neither an assigned floor call nor a car call, the process proceeds in the order Step 51→Step 52→Step 55. In Step 55, it is predicted that the position or floor where the first car is located will be the final calling floor, and this calling floor is set as the final predicted calling floor $h_1$ by taking into account the direction taken by the first car at this time.

When the final predicted calling floor $h_1$ is obtained, the process proceeds to Step 56, where it is determined whether the first car is empty. If the first car is not empty ($AV_1$="0"), the process proceeds to Step 57, where the predicted value of the time $t_1$ required for the first car to become empty (hereafter referred to as the "empty-car predicted time $t_1$") is obtained. The empty-car predicted time $t_1$ is obtained by adding the predicted arrival time $A_1$ when the first car arrives at the final predicted calling floor $h_1$ to the predicted value $T_s$(=10 seconds) of the stop time during which the first car stops at that floor $h_1$. If, in Step 55, the position or floor where the first car is located is set as the final predicted calling floor $h_1$, the remaining time of the stop time is predicted in accordance with the state of the car, for example, travelling, deceleration, a door opening operation, the door opened or a door closing operation. The thus-predicted time is set as the empty-car predicted time $t_1$.

Then, in Step 58, it is determined whether the first car will become empty before the predetermined time T elapses. If the empty-car predicted time $t_1$ is not longer than the predetermined time T, it indicates that the first car becomes empty before the predetermined time T elapses. The process therefore proceeds from Step 58 to Step 59, where the terminal floor indicated by the final predicted calling floor $h_1$ is set as the predicted car position $F_1(T)$ which is reached by the first car when the predetermined time T has elapsed. Also, the predicted car direction $D_1(T)$ is set as "0", where "0" represents the absence of a particular car direction, "1" the upward direction, and "2" the downward direction. Then, in Step 60, the predicted empty-car flag $PAV_1$ of the first car is set to "1".

If the empty-car predicted time $t_1$ of the first car is longer than the predetermined time T, it indicates that the first car has not yet been empty even after the predetermined time T has elapsed. The process therefore proceeds from Step 58 to Step 61, where a terminal floor i, which allows the predicted arrival time $A_1(i-1)$ relative to a floor $i-1$ and the predicted arrival time $A_1(i)$ relative to a floor i to be represented as $\{A_1(i-1)+T_s \leqq T < A_1(i)+T_s\}$, is set as the predicted car position $F_1(T)$ which is reached by the first car when the predetermined time T has elapsed. Further, the same direction as a specific car direction at the floor i is set as the predicted car direction $D_1(T)$. In Step 62, the predicted empty-car flag $PAV_1$ of the first car is reset to "0".

If it is determined in Step 56 that the first car is empty ($AV_1$="1"), the process proceeds to Step 63, where the empty-car predicted time $t_1$ is set to 0 seconds. Then, in Step 64, the terminal floor indicated by the final predicted calling floor $h_1$ is set as the predicted car position $F_1(T)$ which is reached by the first car when the predetermined time T has elapsed. Also, the predicted car position $D_1(T)$ is set to "0". Then, in Step 62, the predicted empty car flag $PAV_1$ of the first car is reset to "0".

In this manner, in Step 65, the predicted car position $F_1(T)$ and the predicted car direction $D_1(T)$ relative to the first car are computed and the predicted empty car is detected. Subsequently, the predicted car positions $F_2(T)$ to $F_4(T)$, predicted car directions $D_2(T)$ to $D_4(T)$ and predicted empty-car flags $PAV_2$ to $PAV_4$ of the respective second to fourth cars are determined in Steps 66 to 68 each having the same procedure as that of Step 65.

Figure 8:
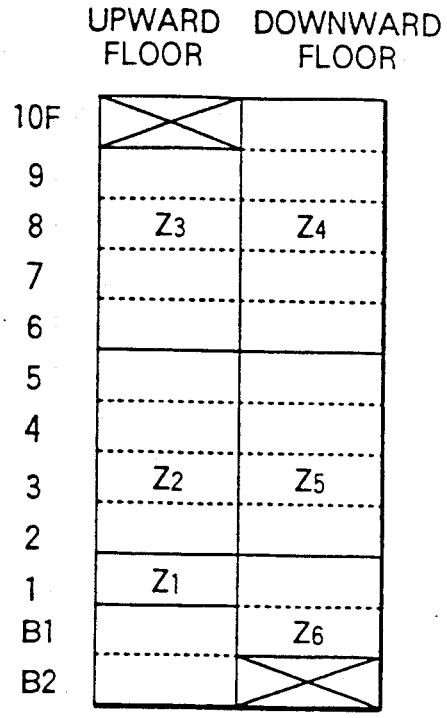
FIG. 8 is a diagram showing the state of zone division in a building.

Referring back to FIG. 3, the number-of-cars predicting program shown as Step 36 computes the number of cars which are located at a predetermined terminal floor or in a predetermined terminal floor zone when the predetermined time T has elapsed, for example, as shown in FIG. 8, the numbers of predicted cars, $N_1(T)$ to $N_6(T)$, are computed for individual terminal floor zones $Z_1$ to $Z_6$ including one or more continuing terminal floors. The number-of-cars predicting program will be explained in detail with reference to FIG. 6.

Figure 6:
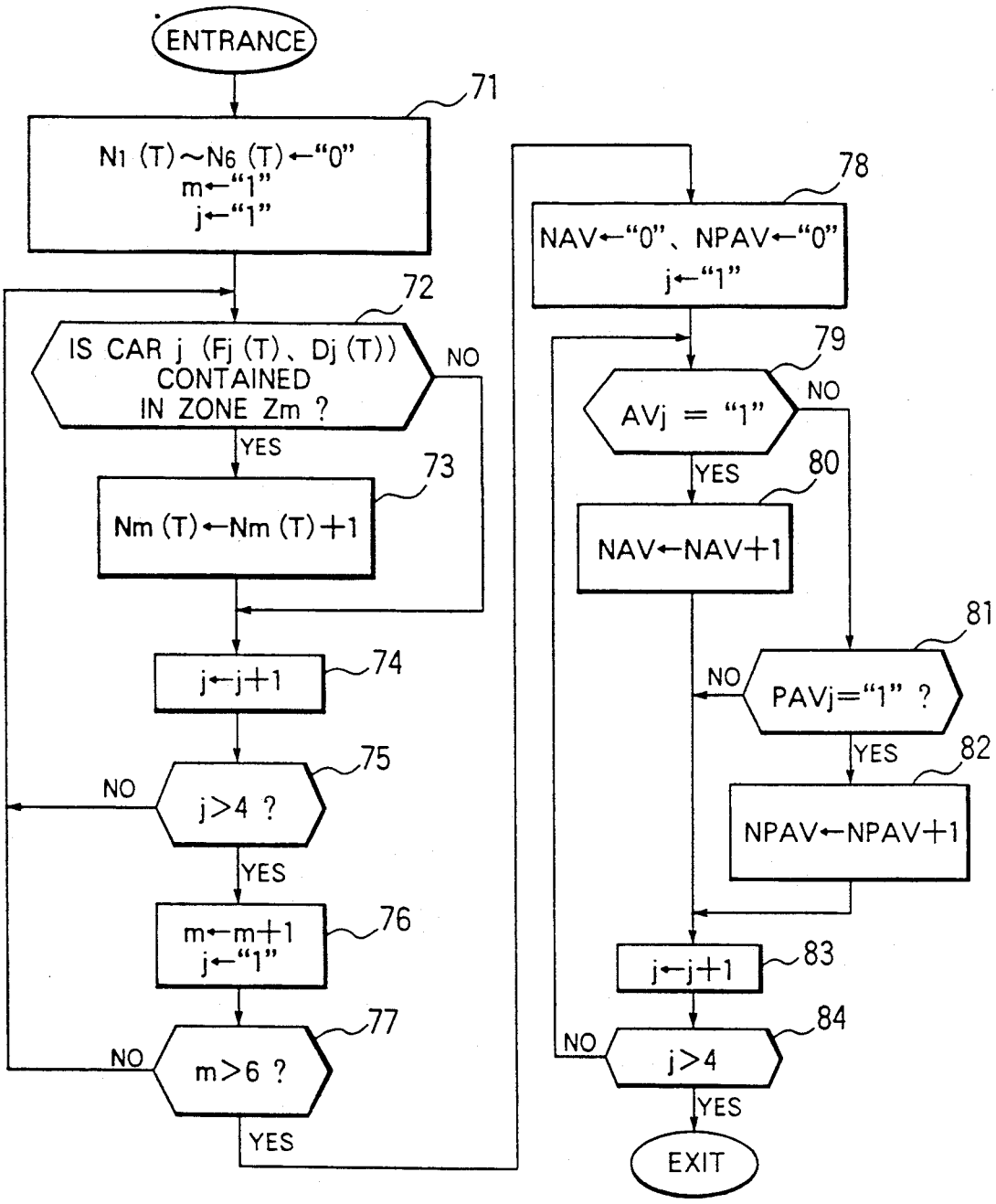
FIG. 6 is a flowchart of the number-of-cars predicting program of FIG. 3.

In the number-of-cars predicting program shown in FIG. 6, in Step 71, the numbers of predicted cars, $N_1(T)$ to $N_6(T)$, are each set to "0", and each of car numbers and zone numbers is set to "1" as their initial values. In Step 72, it is determined whether the $j^{th}$ car is located in a zone Zm when the predetermined time T has elapsed on the basis of the predicted car position $F_j(T)$ and predicted car direction $D_j(T)$ of the $j^{th}$ car. If it is predicted that the $j^{th}$ car is located in the zone Zm, the process proceeds to Step 73, where the number Nm(T) of predicted cars for the zone Zm is incremented by one. When the car number j is incremented by one in Step 74, the process proceeds to Step 75, where it is determined whether decisions as to all the cars have been completed. If all the decisions have not yet been made, the process returns to Step 72 and the above-described steps are again performed.

When all the cars are subjected to the processes of Steps 72 and 73 related to the zone Zm indicated by the zone number m, the process proceeds to Step 76, where the zone number m is incremented by one and the car number j is initialized with "1". Then, the processes of Steps 72 to 75 are repeated until the car number exceeds 4. When the above-described processing has been completed for all the zones $Z_1$ to $Z_6$, the process proceeds to Step 77, where it is determined that the zone number has reached 6. Thus, the process of predicting the number of cars for each zone $Z_1$ to $Z_6$ is completed.

In Steps 78 to 84, the number of empty cars, NAV, and the number of predicted empty cars, NPAV, are counted. Each of the numbers NAV and NPAV is set to "0" in Step 78. If the $j^{th}$ car is empty, the process proceeds from Step 79 to Step 80, where the number of empty cars, NAV, is incremented by one. If the $j^{th}$ car is a predicted empty car, the process proceeds in the order Step 79→Step 81→Step 82. In Step 82, the number of predicted empty cars, NPAV, is incremented by one. In Step 83, the car number j is incremented by one. In Step 84, it is determined whether decisions as to all the cars have been completed. If all the decisions have not yet been completed, the process returns to Step 79, where the aforesaid process is again performed.

In this manner, the numbers of predicted cars, $N_1(T)$ to $N_6(T)$, the number of empty cars, NAV, and the number of predicted empty cars, NPAV, are counted for each zone, thus completing the number-of-cars predicting program 36.

Figure 3:
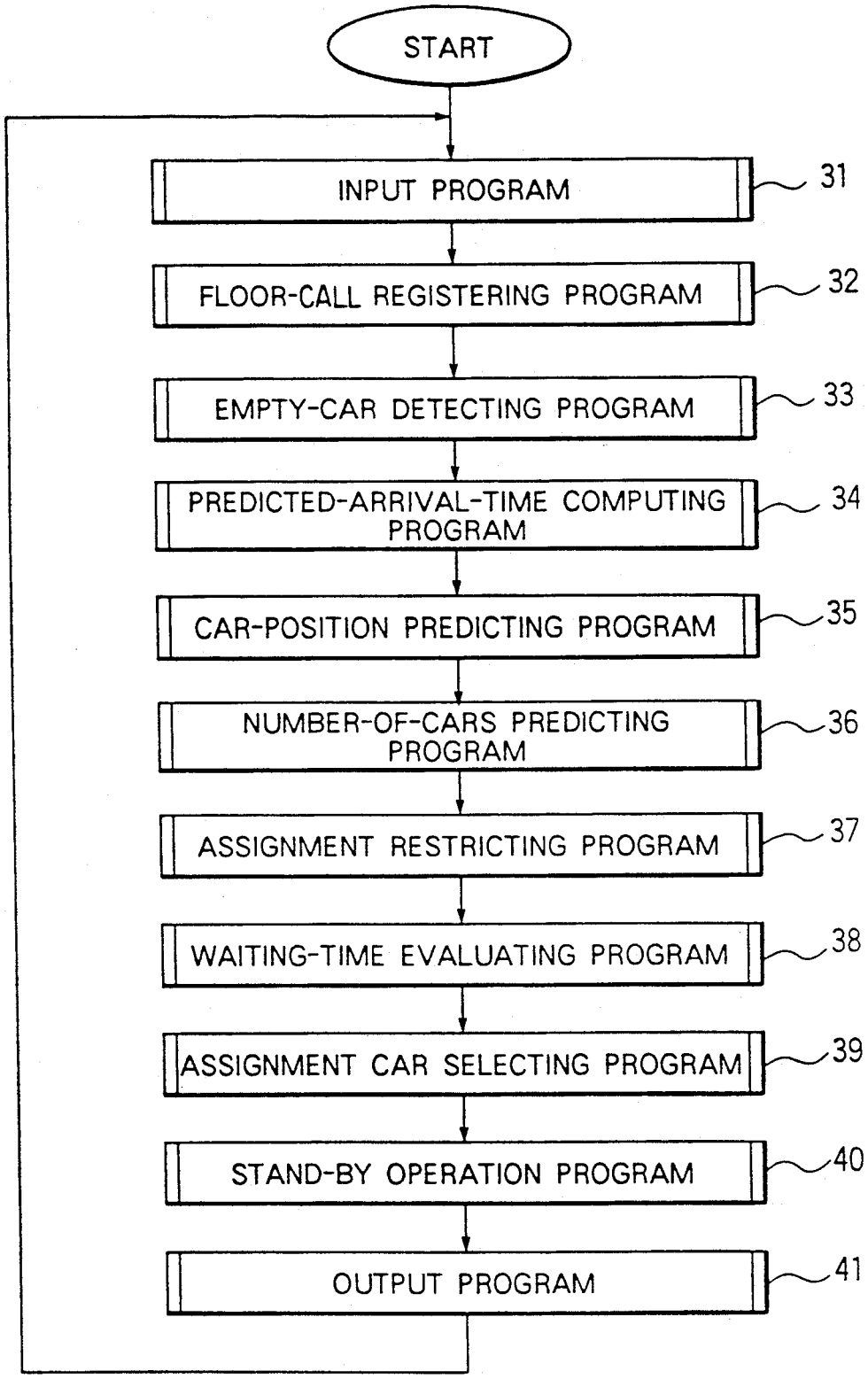
FIG. 3 is a flowchart of a group management program.

In the assignment restricting program shown as Step 37 in the group management program of FIG. 3, when a floor call C is newly registered, it is determined whether the assignment of the first to fourth cars to the floor call C should be restricted, on the basis of the position of a terminal floor corresponding to the floor call C, the number of predicted cars, $N_1(T)$ to $N_5(T)$, the number of empty cars, NAV, and the number of predicted empty cars, NPAV. Assignment restricting values $P_1$ to $P_4$ for making it difficult to assign the respective first to fourth cars to the new floor call C are determined. As each of the assignment restricting values $P_1$ to $P_4$ becomes larger, the degree of assignment restriction becomes higher; that is to say, if a particular assignment restricting value is at infinity, it indicates that the corresponding car is initially eliminated from candidates for assignment. The procedure of such a decision is explained in detail with reference to FIG. 7.

Figure 7:
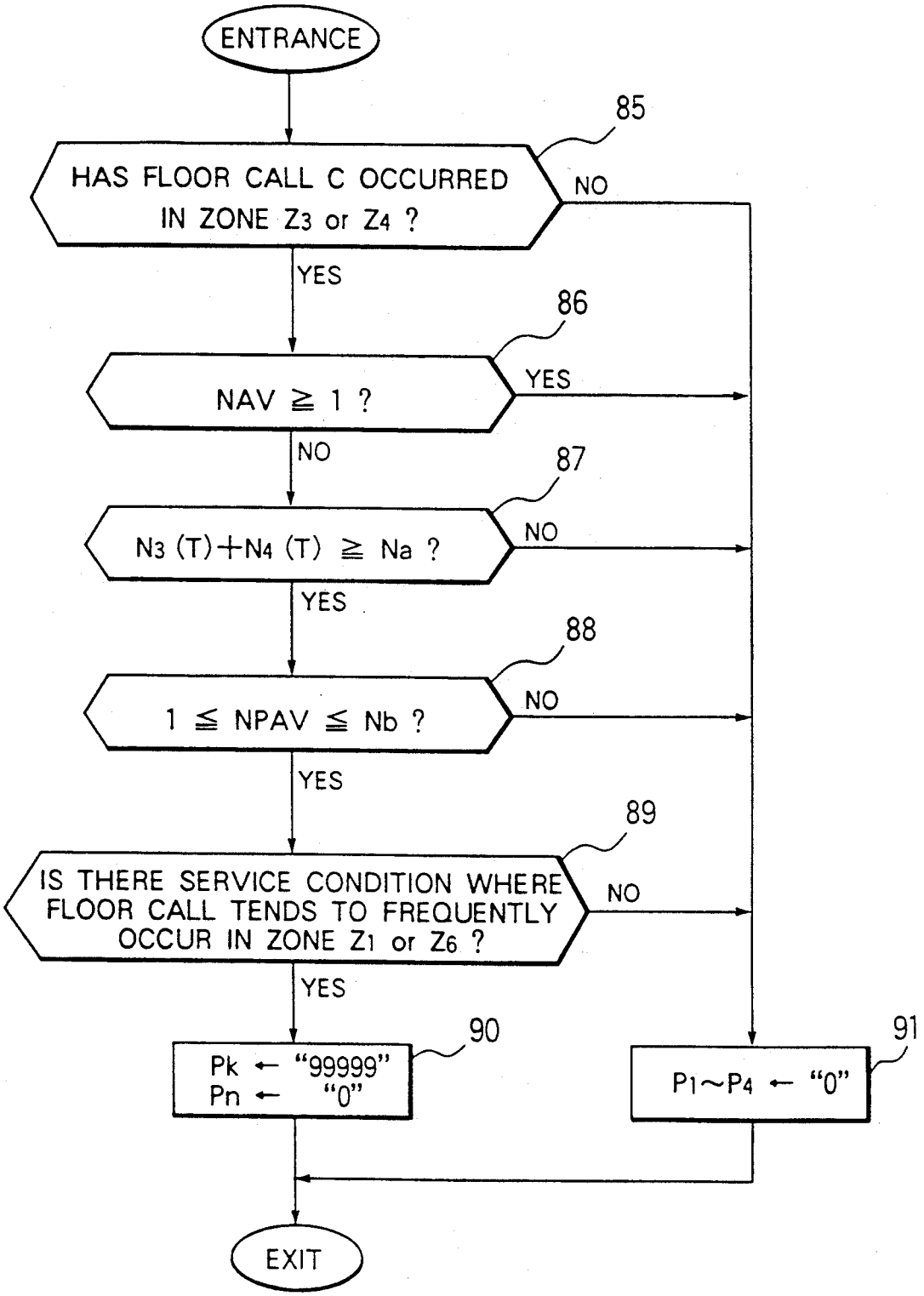
FIG. 7 is a flowchart of the assignment restricting program of FIG. 3.

In the assignment restricting program shown in FIG. 7, the process proceeds in the order Step 85→Step 86→Step 87→Step 88→Step 89→Step 90, if: (1) the new floor call C belongs to the group of floor calls occurring in an upper floor zone ($Z_3$ or $Z_4$), (2) there is no empty car ($NAV<1$), (3) the number of cars which are expected to be located in the upper floor zone ($Z_3$ or $Z_4$) when the predetermined time T has elapsed is as large as $N3(T)+N4(T)\leqq Na$, (4) there are predicted empty cars whose number is as small as $1\leqq NAPV\leqq Nb$, and (5) floor calls tend to frequently occur in a lower floor zone ($Z_1$ or $Z_6$). In Step 90, an assignment restricting value Pk for a predicted empty car k ($k\epsilon\{1, 2, 3, 4\}$) is set to "99999", while an assignment restricting value Pn for a car n ($n\epsilon\{1, 2, 3, 4\}$ and $n\neq k$) other than the predicted empty car is set to "0". In the above-described explanation, Na and Nb are constants. If at least one of the above described conditions is not satisfied, all the assignment restricting values $P_1$ to $P_4$ are set to "0". In this manner, the assignment restricting values $P_1$ to $P_4$ are set.

The waiting time evaluating program shown as Step 38 in the group management program 10 of FIG. 3 performs operations on values $W_1$ to $W_4$ concerning the waiting times derived from the respective floor calls when the new floor call C is temporarily assigned to each of the first to fourth cars. Since operations on the values $W_1$ to $W_4$ of the respective waiting times are known, brief explanation is given. For instance, if the new floor call C is temporarily assigned to the first car, the predicted waiting time $U(i)(i=1, 2, \ldots, 22$: if no floor call is registered, 0 seconds is set) of each floor call i when the floor call C is temporarily assigned to the first car, is obtained. The sum of the squares of the values thus obtained, that is, a waiting-time value $W_1=(U(1)^2+U(2)^2+\ldots+U(22)^2$ is used to calculate the values $W_1$ of the first car.

Then, the assignment car selecting program shown as Step 39 in FIG. 3 selects a single assignment car to which a floor call is to be assigned, on the basis of the assignment restricting values $P_1$ to $P_4$ and the waiting-time values $W_1$ to $W_4$. In the first embodiment, a total value Ej when the new floor call C is temporarily assigned to the $j^{th}$ car is obtained from $Ej=Wj+k\cdot Pj$ (k: constant), and a car corresponding to the minimum total evaluated value Ej is selected as an optimum target car. An assignment command and a warning command corresponding to the floor call C are set for the target car.

If there is an empty car which has responded to all the floor calls, the stand-by operation program shown as Step 40 of FIG. 3 is activated to prevent all the cars from gathering at a specific location. More specifically, the program determines whether the aforesaid empty car should be placed in a stand-by state at the final calling floor or a specific floor. If it is determined that the empty car should be kept on stand-by at a specific floor, a stand-by command to cause the empty car to travel to the specific floor is set for the empty car.

The output program shown as Step 41 of FIG. 3 transmits the floor-button-lamp signal 20 thus set to the predetermined floor and also commands such as an assignment command, a warning command and a stand-by command to of the first to fourth cars and of the controllers 11 to 14.

The group management program 10 including Steps 31 to 41 is repeated in accordance with the above-described procedure.

Then, the operation of the group management program 10 of the first embodiment will be more concretely explained with reference to FIGS. 9 and 10. The examples used in connection with FIGS. 15–18 are again employed for the sake of simplicity.

Figure 9:
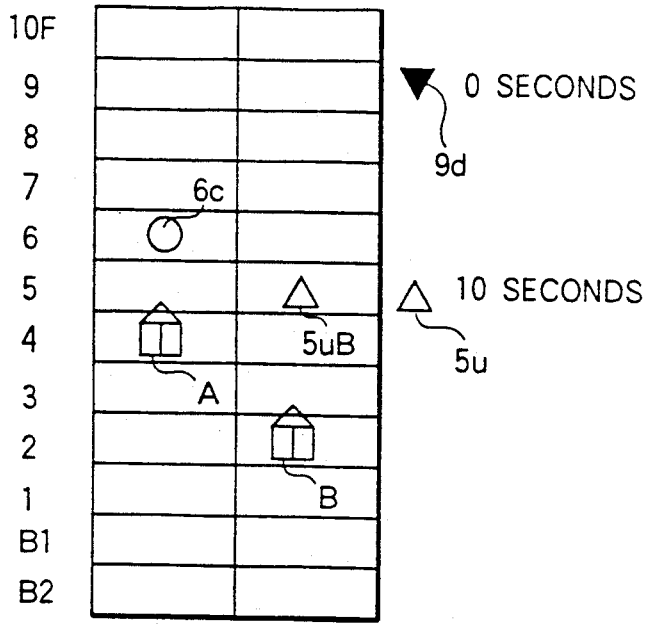
FIGS. 9 and 10 are diagrams showing the relationships between specific calls and car positions in the first embodiment.
Figure 15:
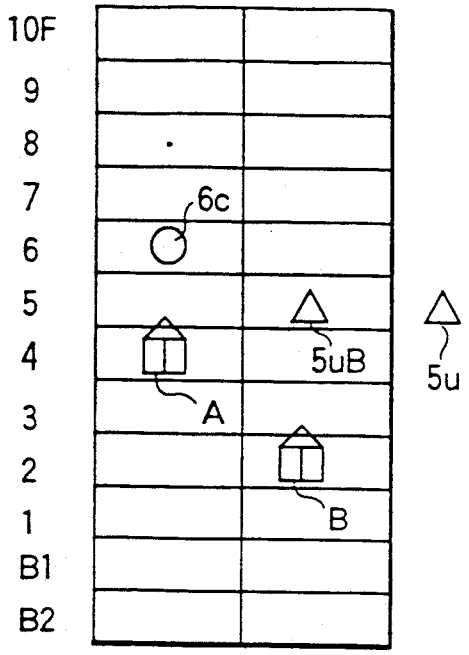
FIGS. 15 thru 22 are diagrams the relationships between specific calls and car positions in a conventional elevator.
Figure 16:
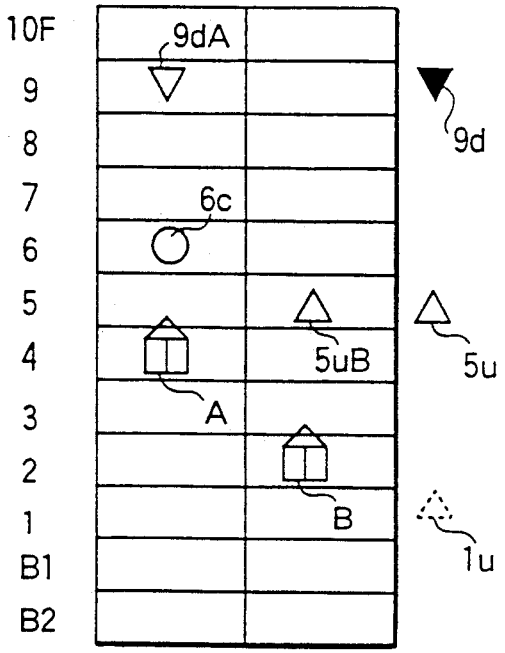
Figure 17:
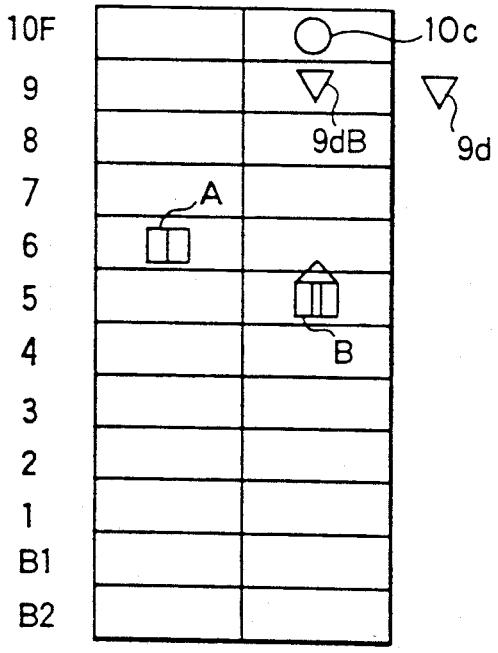
Figure 18:
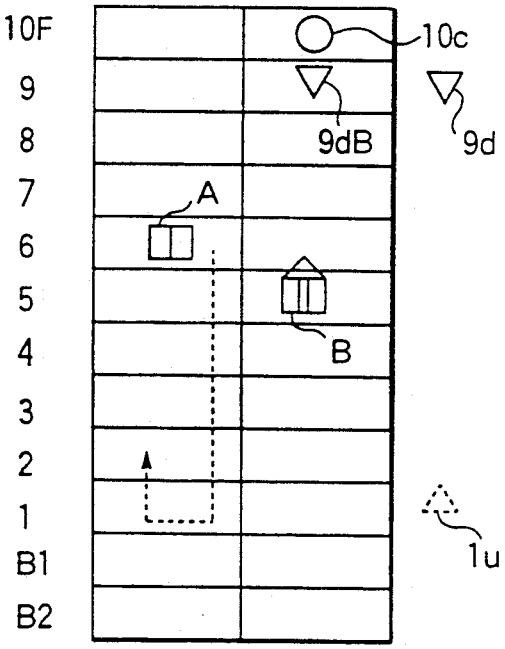
Figure 19:
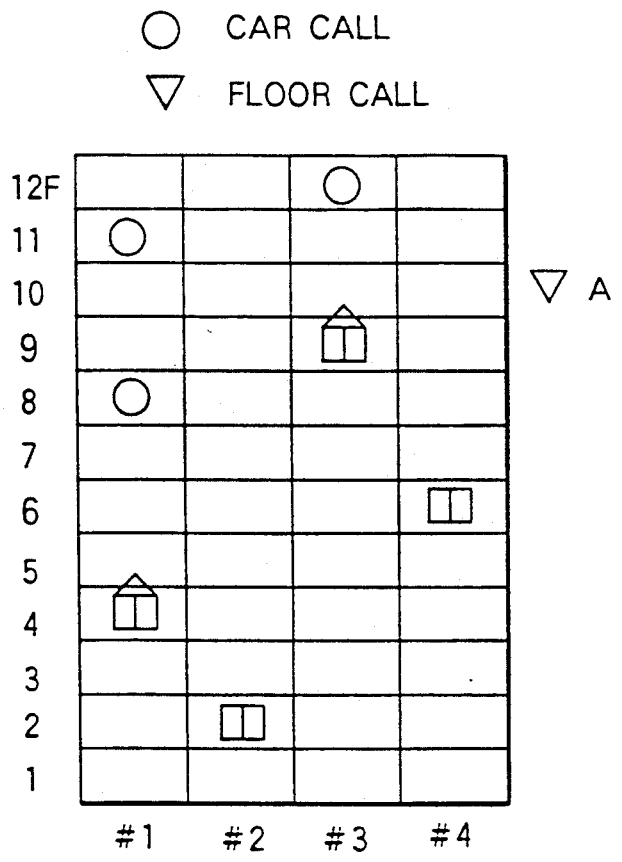

It is assumed that, in the state shown in FIG. 15, a downward call **9*d* at the ninth floor is registered as shown in FIG. 9, in which case the elapsed time of the fifth-floor upward call 5*u* is assumed to be 10 seconds. At this time, when the ninth-floor downward call 9*d* is temporarily assigned to a car A, then the respective predicted waiting times derived from the ninth-floor downward call 9*d* and a fifth-floor upward call 5*u* are 24 seconds and 16 seconds, and the resulting waiting-time evaluated value $W_A$ is $W_A=24^2+16^2=832$. On the other hand, when the ninth-floor downward call 9*d* is temporarily assigned to a car B, the respective predicted waiting times derived from the ninth-floor downward call 9*d* and the fifth-floor upward call 5*u* are 28 seconds and 16 seconds, and the resulting waiting-time evaluated value $W_B$ is $W_B=28^2+16^2=1040$. Accordingly, in a typical conventional assignment method, since $W_A<W_B$, the ninth-floor downward call 9*d*** is assigned to the car A.

Figure 10:
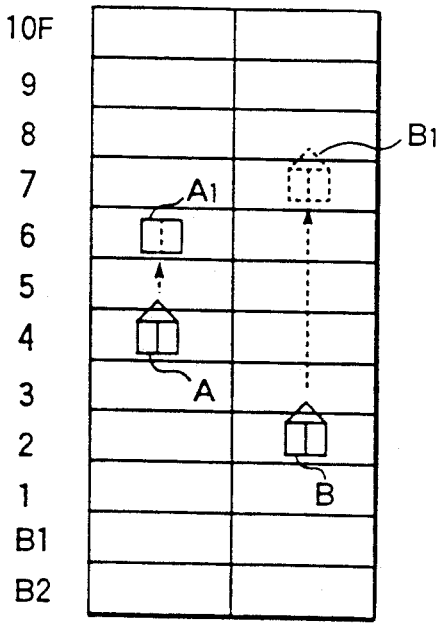

When the predetermined time T ($T=20$ seconds) has passed, the car A and the car B assume the positions shown by cars $A_1$ and $B_1$ in FIG. 10. Accordingly, the numbers of predicted cars in the respective zones $Z_1$ to $Z_6$ are: $N_3(T)=2$; and $N_1(T)=N_2(T)=N_4(T)=N_5(T)=N_6(T)=0$. Therefore, the number of empty cars, NAV, is 0, and the number of predicted empty cars, NPAV, is 1. In the above described example, although a car having no direction is regarded as an upward car, the direction of car travel may be arbitrarily determined in accordance with the position of the car. Also, in the example, if the constant values Na and Nb are 2 and 1, respectively, then $N_3(T)=2$ means that all the cars are located in a single zone. Accordingly, in Step 90 of the assignment restricting program shown in FIG. 7, the assignment restricting value $P_A$ of the car A is set to 99999 and the assignment restricting value $P_B$ of the car B is set to 0. Accordingly, since $E_A > E_B$ with $E_B = W_B + P_B = 1040 + 0 = 1040$ and $E_A = W_A + P_A = 832 + 99999 = 100831$, the total value is finally assigned to the ninth downward call 9d.

In the conventional assignment methods, since the total value is assigned to the car A, cars are easily arranged in a row and a call having an excessively long waiting time frequently occurs. However, in the above-described embodiment, the row-like arrangement of cars is prevented by taking into account the manner in which the cars will have been arranged when the predetermined time T elapses.

As is apparent from the foregoing, in the above-described embodiment, when cars receive individual calls, predictive operations are performed to predict the position and direction which will have been taken by each car when a predetermined time elapses after a specific point in time. Then, the number of predicted empty cars and the number of predicted cars which will have been located in each zone when the predetermined time has elapsed, are computed on the basis of the aforesaid prediction. Subsequently, the predicted empty cars are subjected to an assignment restricting operation on the basis of the number of these predicted cars. Accordingly, since many cars do not gather at one location, it is possible to reduce a waiting time derived from a floor call during the period which elapses from the current point in time to the near future.

In the above-described embodiment, when the position and direction which will have been taken by each car when the predetermined time T has elapsed, are to be predicted, a terminal floor where the car will have been located when it responds to the final floor call and becomes empty, as well as the time required until the car becomes empty is first predicted. On the basis of the terminal floor and the required time, the position and direction which will have been taken by the car when the predetermined time T has elapsed are predicted. This is because it is assumed that, when a car becomes empty at a specific floor, the car stops at that floor. If it is decided that each empty car always stops at a specific floor, the car position and the car direction may be determined on the assumption that the car always travels toward that floor. Also, the car position and the car direction may be predicted by taking into account a call which will newly occur until the predetermined time T elapses. Further, although the above-described embodiment utilizes a method of calculating a final calling predicted floor through a simple process, more accurate and elaborate prediction may be performed on the basis of the statistically calculated probability of occurrence of car calls or floor calls.

Although, in the above embodiment, a single building is divided into zones such as those shown in FIG. 8, it is also possible to easily alter the manner of zone division in accordance with various factors such as the number of terminal floors, the number of cars, different time zones or the use of each terminal floor, for example, whether a main floor, a restaurant floor, a hall floor or a relay floor at which a passenger can change cars as required. In addition, it is not always necessary to determine the arrangement of zones by taking into account the direction in which a car arrives at each floor.

Furthermore, in the above described embodiment, (C1) when the new floor call C belongs to the group of floor calls occurring in an upper floor zone assignment restricting values (>0) for restricting the assignment of the new floor call C to predetermined predicted empty cars are set, respectively if, (1) there is no empty car, (2) a large number of cars are expected to be located in the upper floor zone when the predetermined time T has elapsed, (3) there are predicted empty cars whose number is between 1 and the constant value Nb, and (4) floor calls tend to frequently occur in a lower floor zone.

However, the setting conditions of such an assignment restricting value are not restricted to the above-described examples. For instance, it is also possible to adopt Condition (C2) in which, when the new floor call C belongs to the group of floor calls occurring in an upper floor zone, the following conditions exist: (1) there is no empty car, (2) a large number of cars are expected to be located in the lower floor zone when the predetermined time T has elapsed, (3) there are predicted empty cars whose number is between 1 and the constant value Nb, and (4) floor calls tend to frequently occur in an upper floor zone.

Otherwise, it may be possible to adopt Condition (C3) in which, when the new floor call C belongs to the group of floor calls occurring in an intermediate floor zone, (1) there is no empty car, (2) a large number of cars are expected to be located in the intermediate floor zone when the predetermined time T has elapsed, (3) there are predicted empty cars whose number is between 1 and the constant value Nb, and (4) floor calls tend to frequently occur in an upper floor zone or a lower floor zone.

Otherwise, if it is assumed that a number of cars will gather at a specific location, it may also be possible to adopt Condition (C4) in which, when the new floor call C is registered, (1) there is no empty car, (2) there is a zone which is any one of the upper, lower and intermediate floor zones, in which the new floor call C does not originate, and which does not have any car expected to arrive at it when the predetermined time T has elapsed, (3) there are predicted empty cars whose number is between 1 and the constant value Nb, and (4) floor calls tend to frequent occur in the zone which satisfies the aforesaid item (2). If Condition (4) is satisfied, it is desirable to restrict the assignment of a predicted empty car which is the closest to the zone which satisfies the item (2).

Although, in the item (1) of each of the aforesaid conditions (C1) to (C4), the number of empty cars is selected to be zero, the present invention can also be applied to a case where the number of empty cars is equal to or greater than 1. For example, (C5) when the new floor call C belongs to the group of floor calls occurring in an upper floor zone, if (1) one empty car is located in the upper floor zone, (2) a large number of cars are expected to be located in the upper floor zone when the predetermined time T has elapsed, and (3) there are predicted empty cars whose number is not less than 1 and not more than the constant value Nb, the assignment of the new floor call C to a predetermined predicted empty car may be restricted. This condition (C5) is particularly effective except for a case where a large number of floor calls successively occur in the lower floor zone. More specifically, the use of the condition (C5) contemplates realizing the control not only of quickly causing an empty car to serve the new floor call C but also of causing a car which will soon be empty to serve a floor call which will be registered in a lower floor zone in the near future.

As described above, the item (3) of each of the aforesaid conditions (C1) to (C5) states that there are predicted empty cars whose number is not less than 1 and not more than the constant value Nb. This is because, if there are a large number of predicted empty cars, it is not always necessary to keep predicted empty cars to be subjected to assignment restriction. Even if the term of "not more than the constant value Nb" is deleted and, in the process of selecting predicted empty cars to be subjected to assignment restriction, the assignment of one or two specific cars is restricted, for example, a car which will be empty soonest is selected by utilizing the time t1 as well as times t2-t4 or a car which is closet to a lower floor zone is selected by utilizing the predicted car positions $F_1(T)$-$F_4(T)$ and the predicted car directions $D_1(T)$-$D_4(T)$, it is of course possible to realize similar advantages and effects.

As is apparent from the foregoing. although various other conditions may be employed as conditions for restricting the assignment of floor calls to predicted empty cars on the basis of the number of predicted cars, any condition can be easily realized, as in the case of Condition (C1) shown in FIG. 7.

If a plurality of conditions for individual situations are prepared in addition to the aforesaid conditions (C1) to (C5), more than one condition may occur at the same time In this case, the problem that a car to be subjected to assignment restriction should be selected under which condition, will arise. Although various methods of solving this problem are proposed, certain methods utilize a well-known fuzzy theory. For example, one method is described in detail in the above-recited paper entitled "GROUP MANAGEMENT APPARATUS FOR ELEVATORS", the collection of papers of the meeting associated with electricity and information technologies, vol. 2, P 2, 117-120, 1988. In this method, the probability that each term which constitutes a predetermined condition will be satisfied is represented by values of 0 to 1 in terms of a membership function and, if logical AND results, the minimum value is selected, while, if logical OR results, the maximum value is selected. On the basis of the selection result, the certainty of the condition itself is calculated and a condition having the highest certainty is selected. In another method, the manner of assignment restriction corresponding to each condition is weighted according to the magnitude of certainty and cars are subjected to assignment restriction in accordance with the result of the weighting. It is apparent that the present invention can be applied to the conditions used in such a method. As can be seen from the foregoing, it is possible to select any condition that utilizes the predicted number of cars which will gather at a predetermined floor or in a predetermined floor zone and the number of predicted empty cars which will be empty in the near future.

The above-described embodiment utilizes a method comprising the steps of: setting a greater assignment restricting value for a specific car than for other cars as means for restricting assignment to a floor call; weighting this value to add it to a waiting-time value, thereby providing the total value; and selecting a car having the minimum total value as an optimum car to which the floor call is to be assigned. As is apparent from the foregoing, the fact that the assignment restricting value is combined with another value to perform such total evaluation for assignment purposes means that a car having the minimum assignment restricting value is preferentially subjected to assignment. In other words, a car having a greater assignment restricting value than other cars is difficult to assign to a floor call compared to them.

The type of means for restricting assignment to a floor call is not restricted to the one used in the above-described embodiment. For example, a car which satisfies assignment restricting conditions may be eliminated in advance from the group of car candidates to which a floor call is to be assigned.

Although, in the above-described embodiment, the waiting-time value is the sum of the squares of a predicted waiting value derived from a floor call, the method of calculating the waiting time value is not restricted to the above-described example. It is obvious that the present invention is applicable to, for instance, a method in which the sum of the predicted waiting values corresponding to a plurality of registered floor calls or the maximum value of the predicted waiting time is employed as the waiting-time value. Of course, an evaluation item to be combined with the assignment restricting value is not restricted to the waiting time. The assignment restricting value may be combined with, for example, an evaluation point which consists of an evaluation item such as a prediction error or car full designator.

Figure 11:
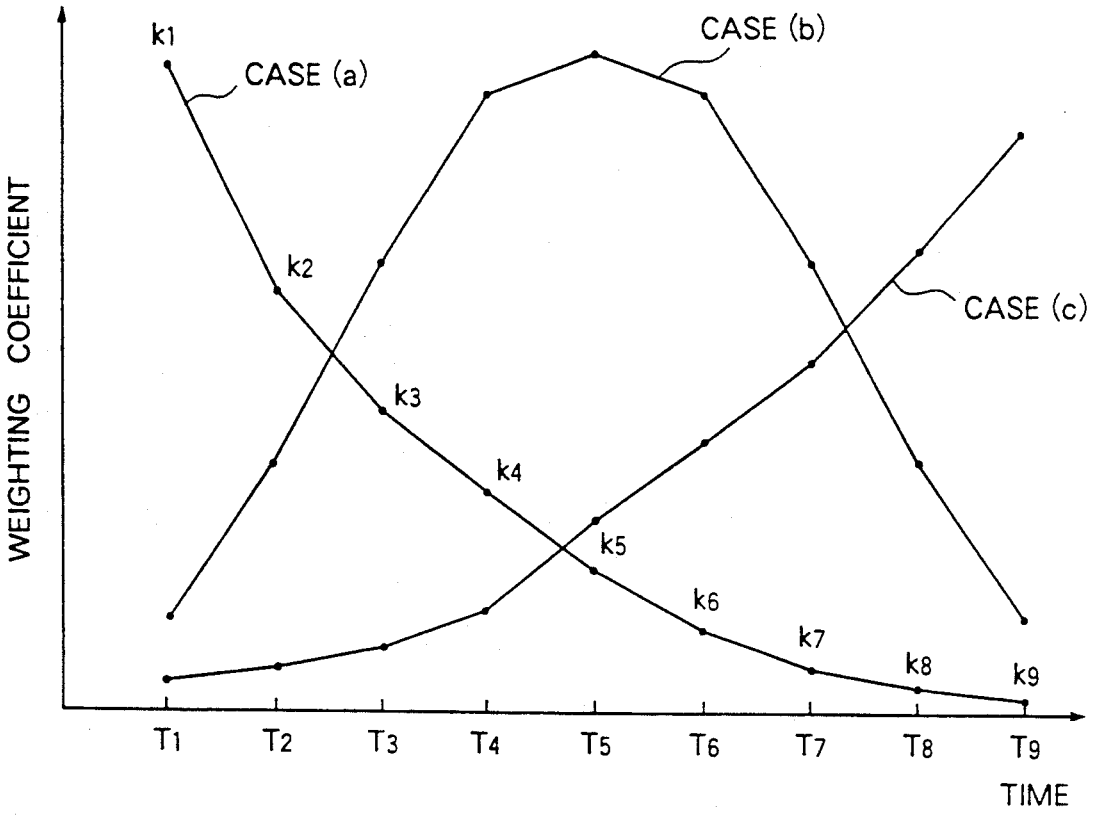
FIG. 11 is a graphic representation showing a modification of the first embodiment.

In the above-described embodiment, the position and direction which will have been taken by each car when one kind of predetermined time T has elapsed are predicted, and, on the basis of the prediction result, the assignment restricting value is calculated. However, a different method may also be employed. For example, different predetermined times T1, T2, . . . , Tr ($T1<T2<\ldots<Tr$) are prepared, and the position and direction which will have been taken by each car when each of the predetermined times has elapsed is predetermined. In addition, the numbers of predicted cars, Nm(T1)-Nm(Tr), which will be located in each zone Zm ($m=1, 2, \ldots$) when each of the predetermined times has elapsed, are computed. Then, the numbers of predicted empty cars, NPAV (T1)-NPAV (Tr), are computed, and assignment restricting values P(T1), P(T2), . . . , P(Tr) which are set in accordance with corresponding combinations $\{N_1(T1), N_2(T1), \ldots, NPAV(T1)\}$, $\{N_1(T2), N_2(T2), \ldots, NPAV(T2)\}$, . . . , $\{N_1(Tr), N_2(Tr), \ldots, NPAV(Tr)\}$, are weighted and added. In other words, it is also possible to easily set a final assignment restricting value P by performing arithmetic operations in accordance with Equation:

$$P=k1\cdot P(T1)+k2\cdot P(T2)+kr\cdot P(Tr)$$

where k1, k2, . . . , kr are weighting coefficients. In this case, only a car position corresponding to a specific time instant T is not evaluated, but car positions corresponding to a plurality of time instants T1, T2, . . . , Tr are totally evaluated. Accordingly, it is possible to further reduce a waiting time derived from a floor call during the period which will elapse from the current point in time to the near future. As shown in, for example, FIG. 11, the setting of the weighting coefficients k1, k2, . . . , kr depends on how to sample car positions corresponding to the respective time instants T1, T2, . . . , Tr. However, it is possible to select the desired setting by taking into account the state of car travel, the characteristics of a building of interest or the like.

Figure 12:
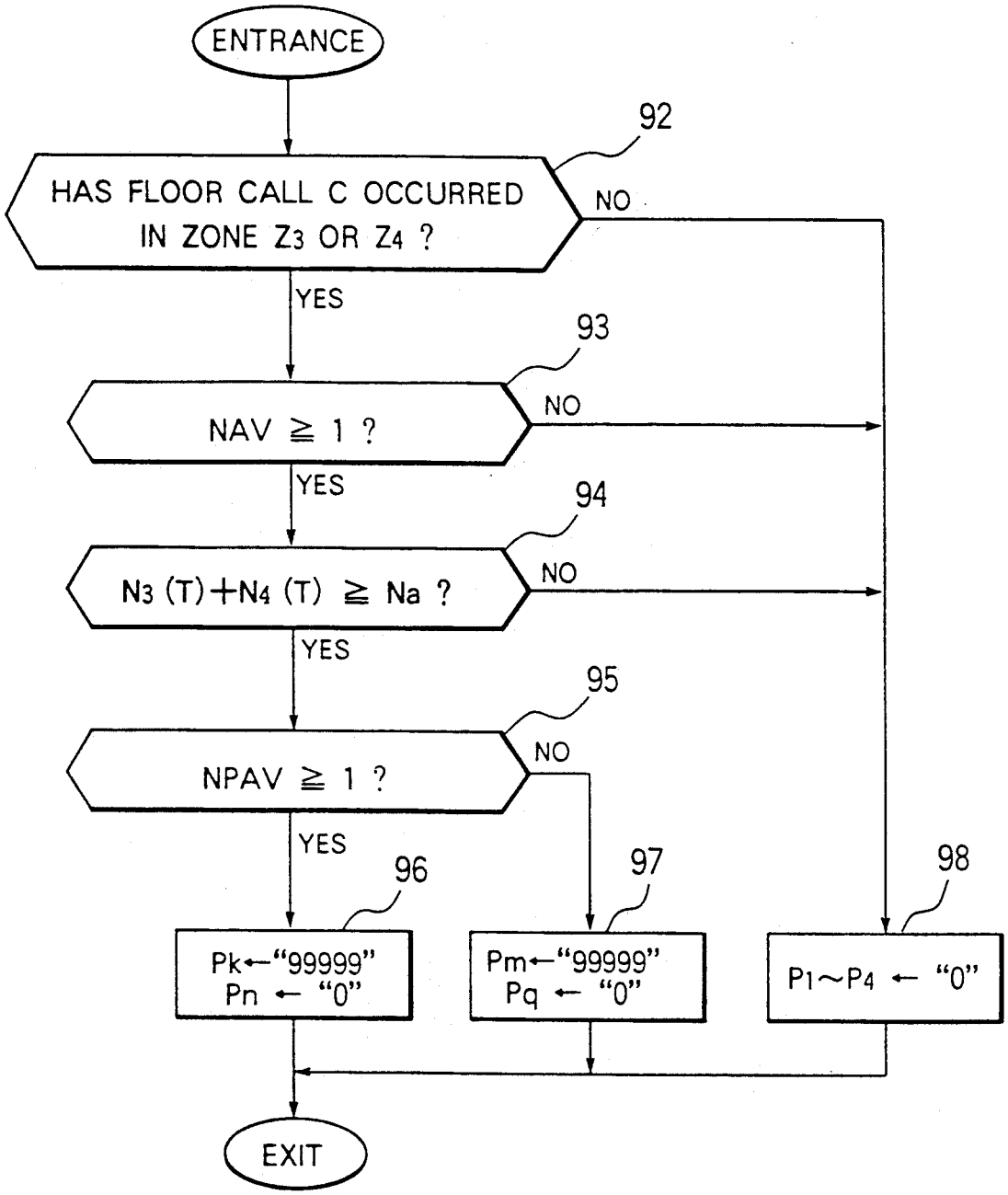
FIG. 12 is a flowchart showing an assignment restricting program according to a second embodiment of the present invention.

FIG. 12 shows a method for effecting assignment restriction according to the second embodiment of the present invention. In FIG. 12, the same symbols are used to denote elements which are similar to those explained in connection with the first embodiment. The arrangement of the second embodiment is substantially the same as that of the first embodiment except that the assignment restricting program shown in FIG. 12 is used in place of the assignment restricting program 37 of the grown management program shown in FIG. 3. In the first embodiment, if there is no empty car ($NAV \geqq 1$), the restriction of assignment to a predicted empty car is conducted in the assignment restricting program 37 shown in FIG. 7. In contrast, in the second embodiment, if there is at least one car ($NAV \geqq 1$), the assignment of a floor call to a predicted empty car or an empty car is restricted in accordance with the presence or absence of a predicted empty car.

The method for effecting assignment restriction according to the second embodiment will now be explained with reference to FIG. 12.

In the assignment restricting program shown in FIG. 12, the process proceeds in the order Step 92→Step 93→Step 94→Step 95→Step 96, if: (1) the new floor call C belongs to the group of floor calls occurring in the upper floor zone ($Z_3$ or $Z_4$), (2) there is at least one empty car ($NAV \geqq 1$), (3) the number of cars which are expected to be located in the upper floor zone ($Z_3$ or $Z_4$) when the predetermined time T has elapsed is as large as $N_3(T)+N_4(T) \geqq Na$, and (4) there is at least one predicted empty car ($NPAV \geqq 1$). In Step 96, the assignment restricting value Pk for the predicted empty car k ($k \epsilon \{1, 2, 3, 4\}$) is set to "99999", while the assignment restricting evaluated value Pn of the car n ($n \epsilon \{1, 2, 3, 4\}$ and $n \neq k$) other than the predicted empty car is set to "0". If it is determined in Step 95 that there is no predicted empty car ($NPAV < 1$), the process proceeds in the order Step 92→Step 93→Step 94→Step 95→Step 97. In Step 97, an assignment restricting value Pm for a predicted empty car m ($m \epsilon \{1, 2, 3, 4\}$) is set to "99999", while an assignment restricting evaluated value Pq for a car q ($q \epsilon \{1, 2, 3, 4\}$ and $q \neq k$) other than the predicted empty car is set to "0". Except for the above-described cases, in Step 98, the assignment restricting values $P_1$ to $P_4$ for all the cars are set to "0". In this manner, the assignment restricting values $P_1$ to $P_4$ are set.

Figure 21:
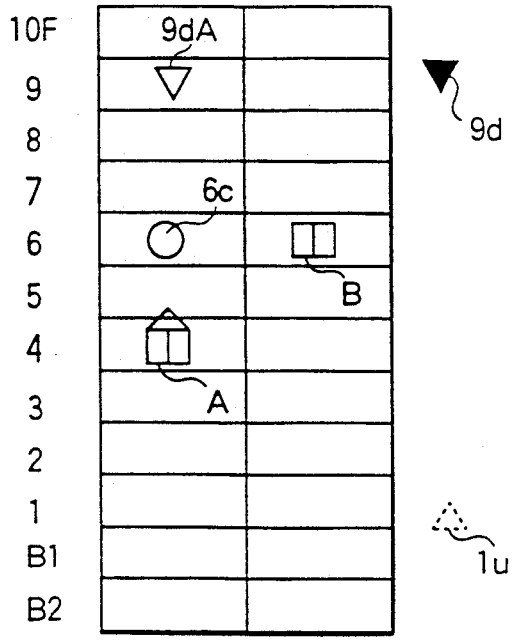
Figure 22:
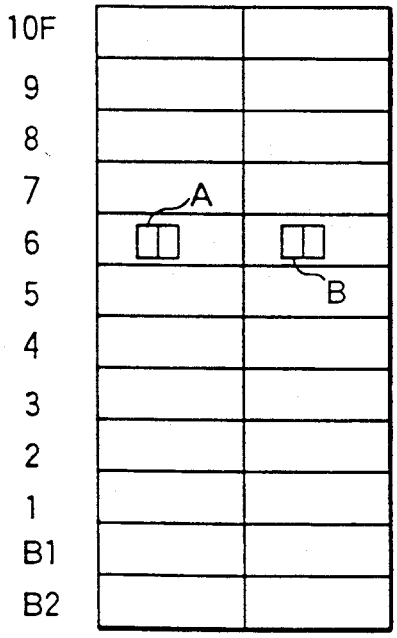

The operation of the group management program in the second embodiment will be more concretely explained with reference to FIGS. 13 and 14. The examples used in connection with FIGS. 20–22 are again employed for the sake of simplicity.

Figure 13:
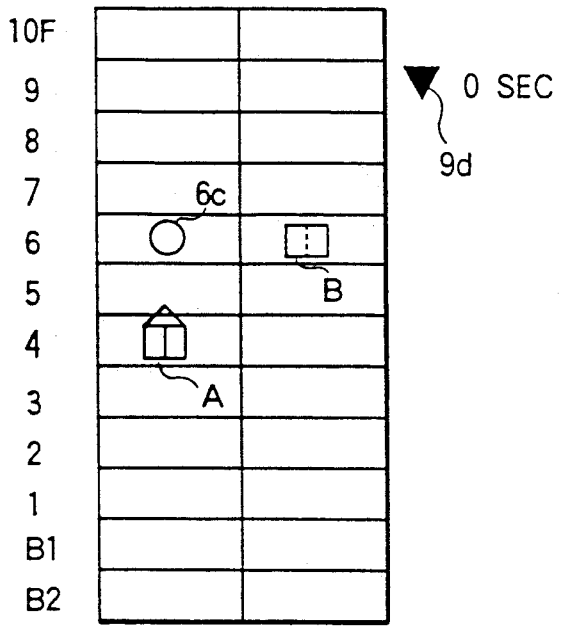
FIGS. 13 thru 14 are diagrams showing the relationships between specific calls and car positions in the second embodiment of the present invention.
Figure 20:
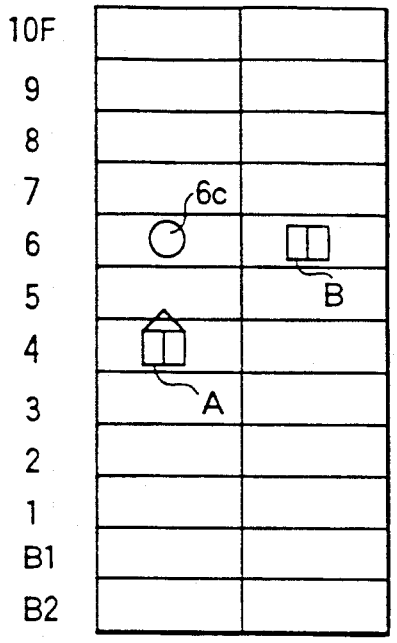

It is assumed that, in the state shown in FIG. 20, a downward call **9*d* at the ninth floor is registered as shown in FIG. 13. At this time, when the ninth-floor downward call 9*d* is temporarily assigned to the car A, the predicted waiting time derived from the ninth-floor downward call 9*d* is 24 seconds, and the resulting waiting-time value $W_A$ is $W_A=24^2=576$. On the other hand, when the ninth-floor downward call 9*d* is temporarily assigned to the car B, the predicted waiting time derived from the ninth-floor downward call 9*d*** is 6 seconds, and the resulting waiting-time evaluated value $W_B$ is $W_B=6^2=36$.

Figure 14:
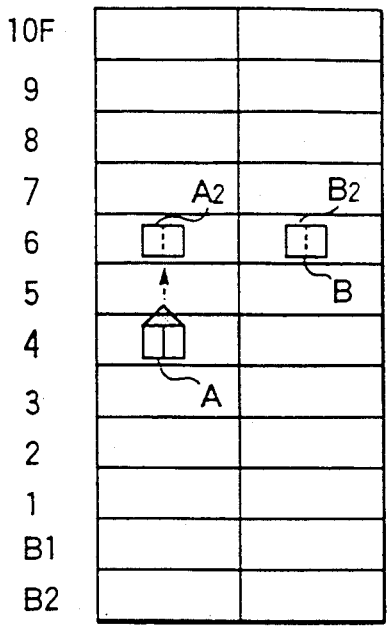

When the predetermined time T (T=20 seconds) has passed, the car A and the car B assume the positions shown by cars $A_2$ and $B_2$ in FIG. 14. Accordingly, the numbers of predicted cars are: $N_3(T)=2$, $N_1(T)=N_2(T)=N_4(T)=N_5(T)=N_6(T)=0$. Therefore, the number of empty cars, NAV, is 0, and the number of predicted empty cars, NPAV, is 1. In the above-described example, although a car having no direction is regarded as an upward car, the direction of car travel may be arbitrarily determined in accordance with the position of the car. Also, in the example, if the constant values Na is 2, then $N_3(T)=2$ means that all the cars are located in a single zone. Accordingly, in Step 96 of the assignment restricting program shown in FIG. 12, the assignment restricting value $P_A$ of the car A is set to "99999" and the assignment restricting value $P_B$ of the car B is set to "0". Accordingly, since $E_A > E_B$ with $E_A=W_A+P_A=576+99999=100575$ and $E_B=W_B+P_B=36+0=36$, the ninth downward call **9*d*** is finally assigned to the car B.

In the above-described second embodiment, (C6) when the new floor call C belongs to the group of floor calls occurring in an upper floor zone, if: (1) a large number of cars are expected to be located in the upper floor zone when the predetermined time T has elapsed, (2) there is at least one empty car, and (3) there is at least one predicted empty car, then assignment restricting values (>0) for restricting the assignment of the new floor call C to predetermined predicted empty cars are set, respectively.

In addition, in the above-described second embodiment, (C7) when the new floor call C belongs to the group of floor calls occurring in an upper floor zone, if: (1) a large number of cars are expected to be located in the upper floor zone when the predetermined time T has elapsed, (2) there is at least one empty car, and (3) there is no predicted empty car, then the assignment restricting evaluated values (>0) for restricting the assignment of the new floor call C to predetermined empty cars are set, respectively.

However, the setting conditions of such an assignment restricting value are not restricted to the above-described examples. For instance, it is also possible to adopt the following conditions (C8) and (C9). In Condition (C8), when the new floor call C belongs to the group of floor calls occurring in a lower floor zone, if: (1) a large number of cars are expected to be located in the upper floor zone when the predetermined time T has elapsed, (2) there is at least one empty car, and (3) there is at least one predicted empty car, then the assignment restricting values (>0) for restricting the assignment of the new floor call C to predetermined predicted empty cars are set, respectively. In addition, in Condition (C9), when the new floor call C belongs to the group of floor calls occurring in a lower floor zone, if: (1) a large number of cars are expected to be located in the upper floor zone when the predetermined time T has elapsed, (2) there is at least one empty car, and (3) there is no predicted empty car, then the assignment restricting values (>0) for restricting the assignment of the new floor call C to predetermined empty cars are set, respectively.

Otherwise, it is also possible to adopt the following conditions (C10) and (C11). In Condition (C10), when the new floor call C belongs to the group of floor calls occurring in an intermediate floor zone, if: (1) a large number of cars are expected to be located in the intermediate floor zone when the predetermined time T has elapsed, (2) there is at least one empty car, and (3) there is at least one predicted empty car, then the assignment restricting values (>0) for restricting the assignment of the new floor call C to predetermined predicted empty cars are set, respectively. In addition, in Condition (C11), when the new floor call C belongs to the group of floor calls occurring in the intermediate floor zone, if: (1) a large number of cars are expected to be located in the upper floor zone when the predetermined time T has elapsed, (2) there is at least one empty car, and (3) there is no predicted empty car, then (4) the assignment restricting values (>0) for restricting the assignment of the new floor call C to predetermined empty cars are set, respectively. Otherwise, if it is assumed that a number of cars will gather at a specific location, it may also be possible to adopt the following conditions (C12) and (C13). In condition (C12), when the new floor call C is registered, if: (1) there is a zone which is any one of the upper, lower and intermediate floor zones, in which the new floor call C does not originate, and which does not have any car expected to arrive there when the predetermined time T has elapsed, (2) there is at least one empty car, and (3) there is at least one predicted empty car, then the assignment restricting values (>0) for restricting the assignment of the new floor call C to predetermined predicted empty cars are set, respectively. In addition, in Condition (C13), when the new floor call C is registered, if (1) there is a zone which is any one of the upper, lower and intermediate floor zones, in which the new floor call C does not originate, and which does not have any car expected to arrive at it when the predetermined time T has elapsed, (2) there is at least one empty car, and (3) there is no predicted empty car, then the assignment restricting values (>0) for restricting the assignment of the new floor call C to predetermined empty cars are set, respectively.

Furthermore, if there are a larger number of predicted empty cars or empty cars which conform to the item (2) or (3) of each of the conditions (C6) to (C13), it is not always necessary to keep predicted empty cars to be subjected to assignment restriction. In such a case, however, during the process of selecting predicted empty cars to be subjected to assignment restriction, the assignment of one or two specific cars is preferably restricted; for example, a car which will be empty soonest may be selected by utilizing the times t1–t4 or a car which is the closest to a lower floor zone is selected by utilizing the predicted car positions $F_1(T)$–$F_1(T)$ and the predicted car directions $D_1(T)$–$D_4(T)$.

As is apparent from the foregoing, although various other conditions may be employed for restricting the assignment of a floor call to empty cars or predicted empty cars, it is possible to easily realize the conditions (C6) and (C7) explained in connection with FIG. 7.

What is claimed is:

1. A group management apparatus for elevators, comprising:

floor-call registering means for registering a floor call which occurs when a floor button is actuated;

assigning means for selecting a car to serve said floor call from among a plurality of cars and then for assigning said selected car to said floor call;

car controlling means for controlling the operation of the car, such as the direction of travel of the car, the start and stop of the car and the opening and closing of the door of the car, and for causing the car to respond to a corresponding car call and floor call;

stand-by means for placing the car in a stand-by state after the car has responding to all car calls;

car-position predicting means sequentially responsive to the car call and the floor call for predicting a car position and a car direction of each of the cars to be realized when a predetermined time has elapsed;

predicted-empty-car detecting means for detecting a car which is expected to have no assigned call when said predetermined time has elapsed, the predicted empty car being determined on the basis of said car position and said car direction predicted by said car-position predicting means; and assignment restricting means for selecting a predicted empty car detected by said predicted-empty-car detecting means to be assigned to a floor call by said assigning means when said floor-call registering means registers said floor call.

2. An apparatus according to claim 1, wherein said car-position predicting means calculates car position and car direction while allowing for a call which is expected to occur during the passage of the predetermined time.

3. An apparatus according to claim 1, further including empty-car detecting means for detecting as an empty car a car having its door closed and no assigned call.

4. An apparatus according to claim 3, wherein said assignment restricting means restricts assignment when said empty-car detecting means does not detect an empty car.

5. An apparatus according to claim 4, wherein said assignment restricting means restricts assignment in cases where a floor call occurs in an upper floor zone, where a large number of cars are expected to be located in the upper floor zone when said predetermined time has elapsed, and where the number of predicted empty cars detected by said predicted-empty-car detecting means is between one and a predetermined value.

6. An apparatus according to claim 5, wherein said assignment restricting means restricts said assignment in a service condition in which a floor call tends to frequently occur in a lower floor zone.

7. An apparatus according to claim 4, wherein said assignment restricting means restricts assignment in cases where:

(a) a floor call occurs in a lower floor zone, (b) a large number of cars are expected to be located in the lower floor zone when said predetermined time has elapsed, and (c) the number of predicted empty cars detected by said predicted-empty-car detecting means is between one and a predetermined value.

8. An apparatus according to claim 4, wherein said assignment restricting means restricts said assignment in a service condition in which a floor call tends to frequently occur in an upper floor zone.

9. An apparatus according to claim 4, wherein said assignment restricting means restricts said assignment in cases where:

(a) a floor call occurs in an intermediate floor zone, (b) a large number of cars are expected to be located in said intermediate floor zone when said predetermined time has elapsed, and (c) the number of predicted empty cars detected by said predicted-empty-car detecting means is between one and a predetermined value.

10. An apparatus according to claim 9, wherein said assignment restricting means restricts said assignment in a service condition in which a floor call tends to frequency occur in an upper floor zone other than said intermediate floor zone.

11. An apparatus according to claim 4, wherein said assignment restricting means restricts said assignment in cases where:

(a) a floor call occurs in any one of upper, lower and intermediate floor zones, (b) there is a zone other than the zone in which said floor call occurs where it is expected that no car is located when said predetermined time has elapsed, (c) and the number of predicted empty cars detected by said predicted-empty-car detecting means is between one and a predetermined value.

12. An apparatus according to claim 11, wherein said assignment restricting means restricts said assignment in a service condition in which a floor call tends to frequency occur in said zone where there is no predicted car.

13. An apparatus according to claim 3, wherein said assignment restricting means restricts said assignment in cases where:

(a) a floor call occurs in an upper floor zone, (b) said empty-car detecting means detects empty cars, (c) a large number of cars are expected to be located in said upper zone when said predetermined time has elapsed, and (d) the number of predicted empty cars detected by said predicted-empty-car detecting means is between one and a predetermined value.

14. An apparatus according to claim 1, wherein said car-position predicting means is operative to perform predictive operations for predicting said car position and said car direction with respect to the passage of predetermined time periods of different duration, said predicted-empty-car detecting means being operative to detect predicted empty cars with respect to the passage of the respective predetermined time periods, said assignment restricting means being operative to restrict assignment of selected cars while including the predicted empty cars detected by said predicted-empty-car detecting means.

15. A group management apparatus for elevators, comprising:

floor-call registering means for registering a floor call which occurs when a floor button is actuated;

assigning means for selecting a car to serve said floor call from among a plurality of cars and for assigning said selected car to said floor call;

car controlling means for controlling the operation of the car, such as the direction of travel of the car, the start and stop of the car and the opening and closing of the door of the car, and for causing the car to respond to a corresponding car call and floor call;

stand-by means for placing the car in a stand-by state after said car has responded to all car calls;

empty-car detecting means for detecting as an empty car a car having no call being responded to with its door closed;

car-position predicting means sequentially responsive to the car call and the floor call for predicting a car position and a car direction of each of the cars to be realized when a predetermined time has elapsed;

predicted-empty-car detecting means for detecting a car which is expected to be empty when said predetermined time has elapsed, the car being detected on the basis of the car position and the car direction predicted by said car-position predicting means; and assignment restricting means for restricting the manner in which at least one empty car detected by said empty-car detecting means is assigned to a floor call by said assigning means when said floor-call registering means registers the floor call, in a case where said empty-car detecting means detects at least one empty car and said predicted-empty-car detecting means does not detect any predicted empty car.

16. An apparatus according to claim 15, wherein said car-position predicting means calculates car position and car direction while allowing for a call which is expected to occur during the passage of the predetermined time.

17. An apparatus according to claim 15, wherein said assignment restricting means restricts the manner in which at least one predicted empty car detected by said predicted empty-car detecting means is assigned to said floor call by said assigning means, in a case where said predicted-empty-car detecting means detects at least one empty car.

18. An apparatus according to claim 17, wherein said assignment restricting means restricts assignment in cases where a floor call occurs in an upper floor zone and where a large number of cars are expected to be located in the upper floor zone when said predetermined time has elapsed.

19. An apparatus according to claim 17, wherein said assignment restricting means restricts assignment in cases where a floor call occurs in a lower floor zone and where a large number of cars are expected to be located in said lower floor zone when said predetermined time has elapsed.

20. An apparatus according to claim 17, wherein said assignment restricting means restricts assignment in cases where a floor call occurs in an intermediate floor zone and where a large number of cars are expected to be located in said intermediate floor zone when said predetermined time has elapsed.

21. An apparatus according to claim 17, wherein said assignment restricting means restricts said assignment in cases where a floor call occurs in any one of upper, lower and intermediate floor zones, where there is a zone other than said zone in which said floor call occurs in which it is expected that no car is located when said predetermined time has elapsed, and wherein the number of predicted empty cars detected by said predicted-empty-car detecting means is between one and a predetermined value.

22. A group management method for elevators, comprising the steps of:

inputting a floor-button signal and a state signal transmitted from a car controller;

registering a floor call on the basis of said floor-button signal and said state signal;

detecting an empty car having no call to be responded to with its door closed;

calculating the predicted arrival time which is required for each car, to arrive at each terminal floor;

calculating a predicted car position and a predicted car direction of each car to be realized when a predetermined time has elapsed;

calculating the number of empty cars, the number of predicted cars which are expected to be located in each zone when said predetermined time has elapsed, and the number of predicted empty cars which are expected to have no call being responded to;

temporarily assigning a floor call to each car on the basis of said number or empty cars, said number of predicted cars and said number of predicted empty cars when said floor call is registered;

evaluating a waiting time derived from said registered floor call which is assigned to each car; and selecting a car to be assigned to said floor call on the basis of the result of said step of evaluating, thereby effecting assignment.

23. A method according to claim 22, wherein said step of temporarily assigning includes restricting assignment in cases where:

(a) said empty car does not exist;

(b) the number of predicted empty cars is between one and a predetermined value, (c) a large number of cars are expected to be located in a zone, (d) said floor call occurs when said predetermined time has elapsed, as well as in a service condition in which a floor call tends to frequently occur in a zone other than the zone containing a large number of cars.

24. A method according to claim 22, where there is at least one empty car present, where a large number of cars are expected to be located in a zone and where the floor call occurs after said predetermined time has elapsed, further including the step of restricting assignment of selected predicted empty cars when at least one predicted empty car is detected and restricting the assignment of selected empty cars when no predicted empty car is detected.

* * * * *

UNITED STATES PATENT AND TRADEMARK OFFICE

CERTIFICATE OF CORRECTION

PATENT NO. : 5,083,640

DATED : JANUARY 28, 1992

INVENTOR(S) : SHINTARO TSUJI

It is certified that error appears in the above-identified patent and that said Letters Patent is hereby corrected as shown below:

Claim 1, Column 19, line 61, change "responding" to --responded--.

Claim 8, Column 20, line 45, change "4" to --7--.

Claim 13, Column 21, line 19, after "upper" insert --floor--.

Claim 15, Column 21, line 49, change "the" to --said--.

Claim 21, Column 22, line 42, change "wherein" to --where--.

Claim 23, Column 23, line 10, change ";" to --,--.

Signed and Sealed this

Thirteenth Day of April, 1993

*Attest:*

STEPHEN G. KUNIN

*Attesting Officer*

*Acting Commissioner of Patents and Trademarks*